US006608975B2

(12) United States Patent
Sakurai et al.

(10) Patent No.: US 6,608,975 B2
(45) Date of Patent: Aug. 19, 2003

(54) IMAGE FORMING APPARATUS AND CARTRIDGE DETACHABLY MOUNTABLE THERETO

(75) Inventors: Kazushige Sakurai, Mishima (JP); Tomomi Kakeshita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/266,744

(22) Filed: Oct. 9, 2002

(65) Prior Publication Data

US 2003/0031478 A1 Feb. 13, 2003

Related U.S. Application Data

(63) Continuation of application No. 09/689,734, filed on Oct. 13, 2000.

(30) Foreign Application Priority Data

Oct. 15, 1999 (JP) ..... 11-294584
Oct. 15, 1999 (JP) ..... 11-294588

(51) Int. Cl.[7] ..... G03G 15/00
(52) U.S. Cl. ..... 399/25; 399/111
(58) Field of Search ..... 399/13, 24, 25, 399/26, 27, 31, 32, 42, 43, 48, 50, 53, 55, 111

(56) References Cited

U.S. PATENT DOCUMENTS

| | | | | |
|---|---|---|---|---|
| 4,961,088 A | | 10/1990 | Gilliland et al. | 399/25 |
| 5,272,503 A | | 12/1993 | LeSueur et al. | 399/25 |
| 5,572,292 A | * | 11/1996 | Chatani et al. | 399/25 |
| 5,835,818 A | * | 11/1998 | Hoshika et al. | 399/26 |
| 5,923,917 A | | 7/1999 | Sakurai et al. | 399/27 |
| 5,963,759 A | | 10/1999 | Kojima et al. | 399/25 |
| 5,995,774 A | * | 11/1999 | Applegate et al. | 399/27 |
| 6,070,022 A | | 5/2000 | Kobayashi et al. | 399/12 |
| 6,137,966 A | * | 10/2000 | Uehara et al. | 399/13 |
| 6,188,852 B1 | | 2/2001 | Ojima et al. | 399/25 |
| 6,205,298 B1 | | 3/2001 | Yamamoto | 399/25 |
| 6,229,970 B1 | | 5/2001 | Onimura et al. | 399/50 |

FOREIGN PATENT DOCUMENTS

| | | |
|---|---|---|
| EP | 0 532 308 | 3/1993 |
| EP | 0 822 469 | 2/1998 |
| EP | 0 877 304 | 11/1998 |
| JP | 4-299375 | 10/1992 |
| JP | 9-120198 | 5/1997 |

OTHER PUBLICATIONS

Patent Abstracts of Japan, vol. 1998, No. 6, 30, Apr. 30, 1998 (JP 10–039723).
Patent Abstracts of Japan, vol. 011, No. 276 (P–613), Sep. 8, 1987 (JP 62–075667).

* cited by examiner

*Primary Examiner*—Hoan Tran
(74) *Attorney, Agent, or Firm*—Fitzpatrick, Cella, Harper & Scinto

(57) ABSTRACT

An image forming apparatus includes an image forming device for forming an image on a recording material, wherein at least a part of the image forming device is in the form of a unit which is detachably mountable to a main assembly of the apparatus, the apparatus includes a memory, wherein the memory is mounted to the unit, wherein the memory stores information relating to the timing at which a driving parameter of the image forming device is changed.

11 Claims, 34 Drawing Sheets

IMAGE FORMING APPARATUS AND CARTRIDGE DETACHABLY MOUNTABLE THERETO

CROSS REFERENCE TO RELATED APPLICATION

This Application is a continuation of U.S. patent application Ser. No. 09/689,734, filed Oct. 13, 2000.

FIELD OF THE INVENTION AND RELATED ART

The process cartridge contains the electrophotographic photosensitive member, and at least one of charging means, developing means and cleaning means, in the form of a cartridge which is detachably mountable to the main assembly of the image forming apparatus. Furthermore, the process cartridge may contain at least the electrophotographic photosensitive member and the developing means.

In an image forming apparatus such as a copying machine, a laser beam printer or the like of an electrophotographic type, an electrophotographic photosensitive member is exposed to light modulated in accordance with image information so that an electrostatic latent image is formed thereon, and the latent image is developed with a developer (toner) by developing means. The developed image is transferred onto a recording material, such as paper from said photosensitive member.

The process cartridge may further comprise a toner accommodating portion and a residual toner container for the purpose of easy maintenance and exchange of the consumables, such as toner. In the case of a color image forming apparatus, there are provided a plurality of developing means, and the degree of wear of the developing means may be different. The degree of wear of the photosensitive drum and the developing means may be different. In view of them, some parts may be formed into a smaller cartridge, for example, the developing cartridge for each color, the cleaning means and the photosensitive drum may be formed into a cartridge (photosensitive member cartridge).

It is known that storing means (memory) may be carried on the cartridge, and the information peculiar to the cartridge is managed. In U.S. Pat. No. 5,272,503, the degree of use of the cartridge is stored in the memory, in accordance with which various process conditions are controlled. For example, the charging current value and/or the exposure amount is adjusted. The same control is carried out if the degree of use is the same, despite the fact that the cartridge is different.

Japanese Laid-open Patent Application Hei 9-120198 discloses that a driving parameter of image forming means (the voltage applied to the charger or the current applied to the exposure means) is switched in accordance with the degree of use of the cartridge, so that the image quality is maintained constant from the start of use to the end of the cartridge.

However, even if the cartridges are manufactured under the same design, and the driving parameter of the image forming means is controlled, the image quality is not uniform if the lots of manufacture are different and/or if the use timing is different.

SUMMARY OF THE INVENTION

Accordingly, it is a principal object of the present invention to provide an image forming apparatus and a cartridge detachably mountable to the main assembly of the image forming apparatus, wherein the image quality is stabilized despite a degree of usage of the cartridge.

It is another object of the present invention to provide an image forming apparatus and a cartridge detachably mountable to the main assembly of the image forming apparatus, wherein the image quality is stabilized despite the difference of manufacturing lots.

According to an aspect of the present invention, there is provided an image forming apparatus comprising image forming means for forming an image on a recording material, wherein at least a part of the image forming means is in the form of a unit which is detachably mountable to a main assembly of the apparatus, the apparatus comprising a memory, wherein the memory is mounted to the unit, wherein the memory stores information relating to the timing at which a driving parameter of the image forming means is changed.

According to another aspect of the present invention, there is provided an image forming apparatus comprising forming means for forming an image on a recording material, wherein at least a part of the image forming means is formed into a unit which is detachably mountable to a main assembly of the apparatus; memory, wherein the memory is provided in the unit, wherein the memory stores information for setting a driving parameter for the image forming means upon start of use of the unit.

According to a further aspect of the present invention, there is provided a unit detachably mountable to an image forming apparatus including image forming means for forming an image on a recording material, the unit comprising at least part of the image forming means; a memory; wherein the memory stores information relating to timing for changing a driving parameter of the image forming means.

These and other objects, features and advantages of the present invention will become more apparent upon a consideration of the following description of the preferred embodiments of this present invention taken in conjunction with the accompanying drawings.

DESCRIPTION OF THE PREFERRED EMBODIMENTS

Hereinafter, a process cartridge, an image forming apparatus in which a process cartridge is removably installable, an image formation system, and a memory medium for a process cartridge, in accordance with the present invention, will be described with reference to the appended drawings.

Embodiment 1

Figure 1:
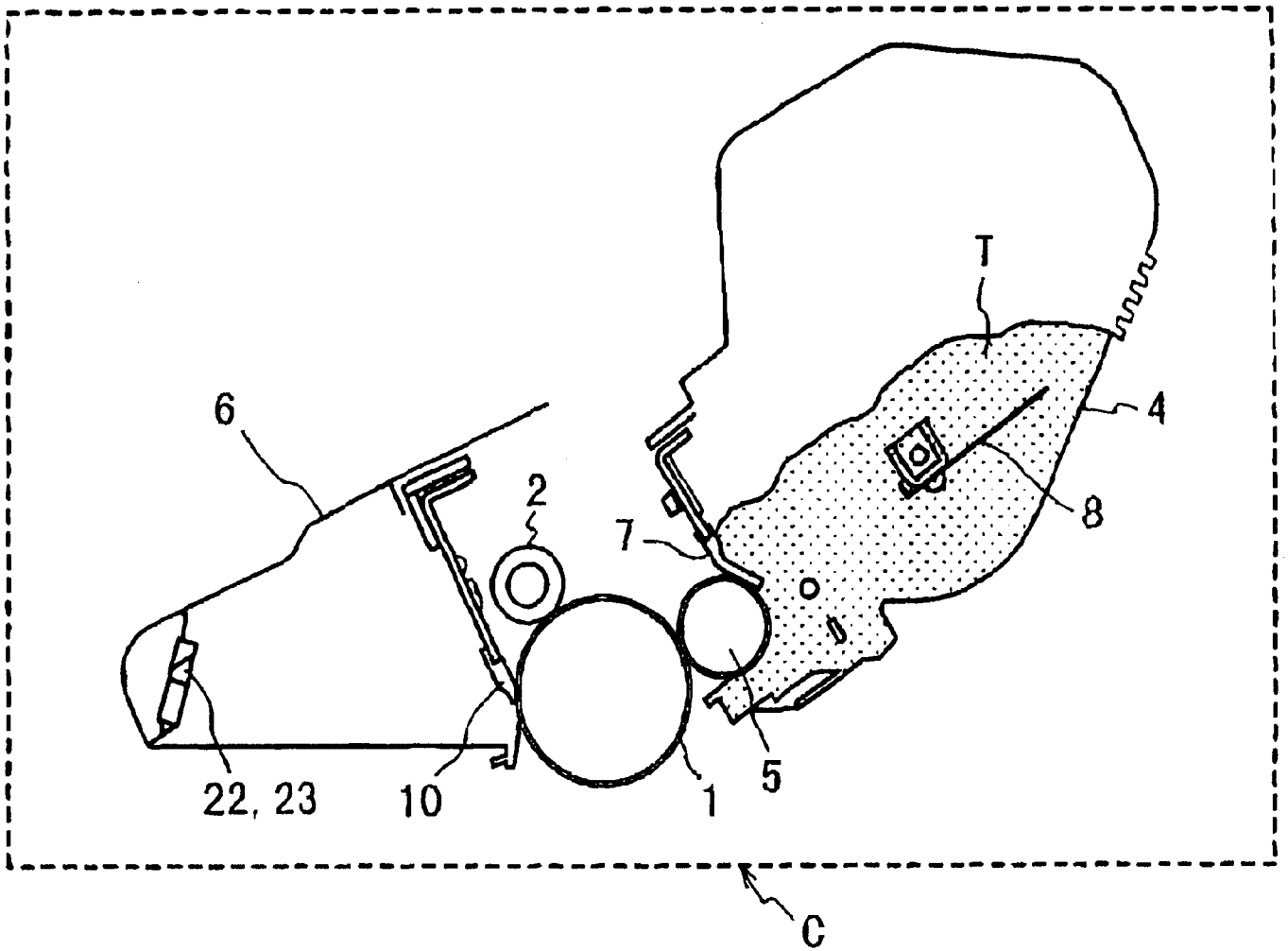
FIG. 1 is a sectional view of the process cartridge in the first embodiment of the present invention.

First, referring to FIGS. 1 and 2, an embodiment of an image forming apparatus in which a process cartridge structured in accordance with the present invention is installable will be described. In this embodiment, the image forming apparatus is a laser beam printer which receives image information from a host computer, and outputs the image information as an image. It is an image forming apparatus in which a process cartridge, in which expendables such as an electrophotographic photosensitive member in the form of a drum, that is, a photosensitive drum, developer, and the like, are disposed, can be removably installable. First, referring to FIGS. 1 and 2, the electrophotographic image forming apparatus and process cartridge in this embodiment will be described.

In this embodiment, the process cartridge C integrally comprises a developer container 4 and a waste toner container 6. The developer container 4 integrally holds: a photosensitive member in the form of a drum, that is, the photosensitive drum 1; a contact charge roller 2 for uniformly charging the photosensitive drum 1; and a development sleeve 5 which constitutes a developing means, and is placed virtually in contact with the photosensitive drum 1, its generatrix being parallel to that of the photosensitive drum 1. Further, the developer container 4 contains a developer T and rotationally supports the development sleeve 5. The waste toner container 6 holds a cleaning blade which constitutes a cleaning means, and the residual toner particles removed from the photosensitive drum 1 by the cleaning blade 10. This process cartridge C is removably installed into an installing means 101 (FIG. 2) provided in the main assembly 100 of the image forming apparatus, by a user.

The development sleeve 5 of the developing means comprises a nonmagnetic aluminum base with a diameter of 16 mm, and a resin layer coated on the peripheral surface of the base. The resin layer contains electrically conductive particles. Although not illustrated, a magnetic roll with four magnetic poles is placed in the development sleeve 5. To the shell of the developer container 4, a development blade, that is, a developer regulating member 7, is attached. The developer regulating member 7 in this embodiment is formed of silicone rubber with a hardness of approximately 40 deg. in JIS scale, and is kept in contact with the development sleeve 5 with the application of a predetermined amount of pressure (contact pressure) in a range of 30–40 gf/cm (contact load per centimeter in the longitudinal direction of the development sleeve 5).

The developer T stored in the developer container 4 in this embodiment is a nonmagnetic single component toner (hereinafter, toner) and is negatively chargeable. The ingredients of the developer T are copolymer of styrene-butylacrylate (100 parts in weight) as bonding resin, magnetic particles (80 parts in weight), monoazoic complex (2 parts in weight) as negative charge controlling agent, and polypropylene with low molecular weight (3 parts in weight) as wax. In production, these ingredients are mixed and melted in a double axis extruder heated to 140° C. After cooling, the mixture is pulverized into relatively large particles by a hammer mill, and then, further pulverized into microscopic particles by a jet mill. The thus obtained microscopic particles are classified by air flow, collecting particles with a weight average diameter of 5.0 $\mu$m. Then, one part by weight of microscopic hydrophobic silica particles is mixed by one part by weight into 100 parts in weight of the classified particles with a weight average diameter of 5.0 $\mu$m with the use of a Henschel mixer to yield the developer T in this embodiment. In reality, the toner particles with a weight average particle diameter within a range of 3.5–7.0 $\mu$m (mostly, 6 $\mu$m) are used as the developer in this embodiment.

The development bias applied to the development sleeve 5 is a combination of a DC voltage of −450 V, and an AC voltage with a rectangular waveform, a peak-to-peak voltage of 1600 V, and a frequency of 2300 Hz, when the gap between the photosensitive drum 1 and development sleeve 5 is approximately 300 $\mu$m for example.

There is a toner stirring means 8 in the developer container, that is, the toner container 4, which rotates once every six seconds to convey the toner T in the toner container 4 to the development region, while loosening the toner T.

The development roller 2 comprises a metallic core, and an electrically conductive elastic layer formed on the peripheral surface of the metallic core. It is rotationally supported at the longitudinal ends of the metallic core, being kept in contact with the peripheral surface of the photosensitive drum 1 with the application of a predetermined amount of pressure. It follows the rotation of the photosensitive drum 1. To the charge roller 2, a compound voltage (Vac+Vdc) comprising an AC component Vac with a peak-to-peak voltage Vpp of twice the charge start voltage, and a DC component Vdc, is applied from the high voltage power source provided within the image forming apparatus main assembly 100 through the metallic core. As a result, the peripheral surface of the photosensitive drum 1 is uniformly charged by the charge roller 2 which is in contact with the peripheral surface of the photosensitive drum 1.

The charge bias applied to the charge roller 2 is combination of a DC voltage of −600 V, and an AC voltage with a sinusoidal waveform, a Vpp of 2 kV, and a frequency of 1500 Hz. Its effective current value is 1400 $\mu$A. With the application of this charge bias, the photosensitive drum 1 is charged to the potential level vd of −600 V. After the exposure by a laser beam, the potential level VL of an exposed area is −150. The exposed areas (areas with the potential level of VL) are reversely developed.

Figure 2:
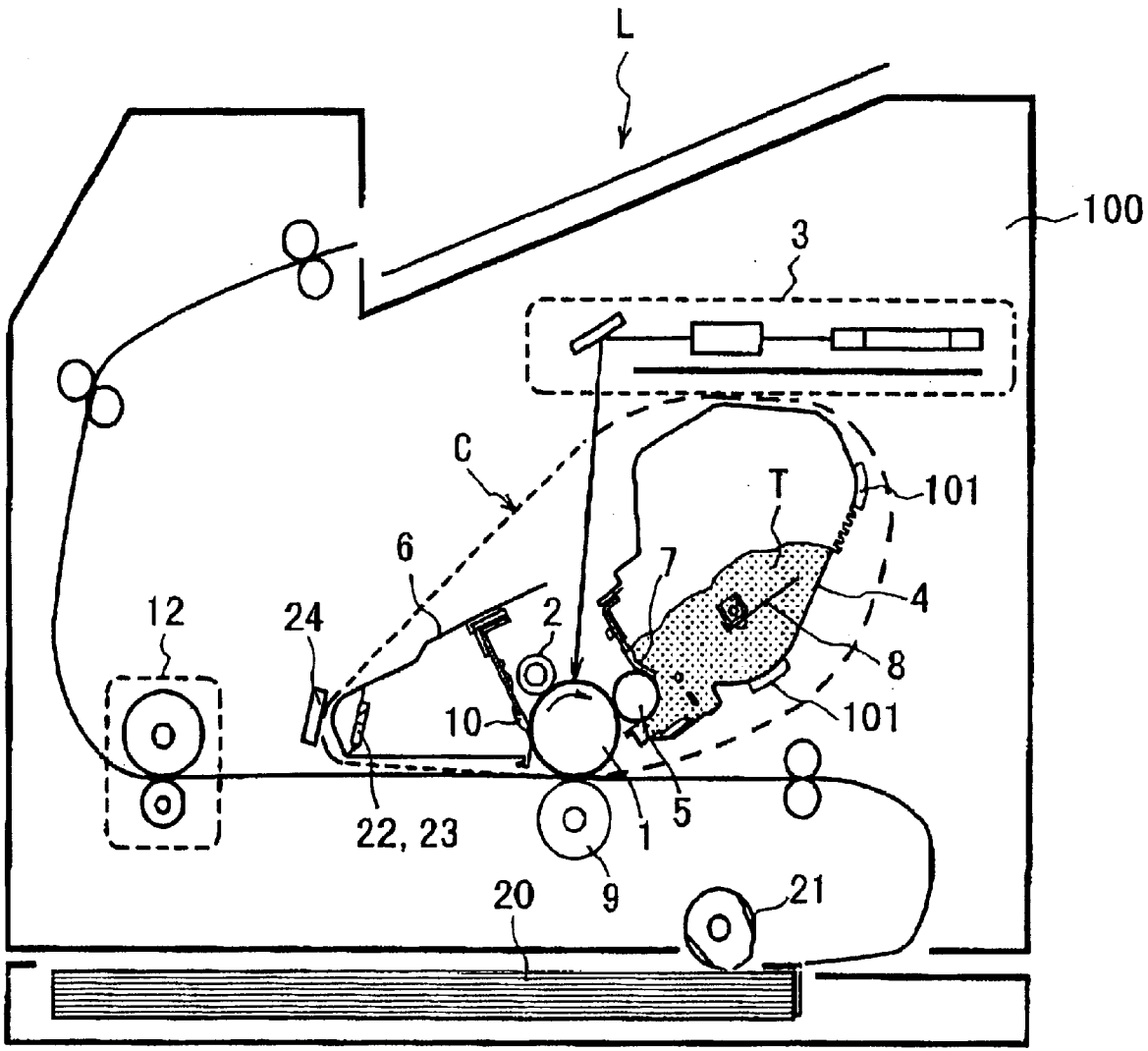
FIG. 2 is a sectional view of the image forming apparatus in the first embodiment of the present invention, which employs a process cartridge.

FIG. 2 shows the general structure of a laser printer L, that is, an image forming apparatus. The cylindrical photosensitive drum 1 as a latent image bearing member is rotated in the direction of an arrow mark about its rotational axis supported by the image forming apparatus main assembly 100. After the photosensitive drum 1 is uniformly charged across the peripheral surface by the charge roller 2, a latent image is formed on the peripheral surface of the photosensitive drum 1 by an exposing apparatus 3. The latent image formed on the peripheral surface of the photosensitive drum 1 is supplied with the toner T by the development sleeve 5, which is a part of the developing apparatus, becoming a visible image. Between the photosensitive drum 1 and development sleeve 5, a bias supplying power source (unillustrated) is connected, which applies the combination of DC bias and AC bias so that a proper amount of development bias is provided.

The toner image formed on the photosensitive drum 1 by visualizing the latent image on the photosensitive drum 1 with the toner T as described above is transferred onto a recording medium 20 such as a piece of recording paper by a transfer roller 9. The recording medium 20 is fed by a sheet feeding roller 21, and is sent to the transfer roller 9, in synchronism with the toner image on the photosensitive drum 1, by a registration roller (unillustrated). After being transferred onto the recording medium 20, the visual image formed by the toner T is conveyed, along with the transfer medium 20, to a fixing apparatus 2, in which it is fixed to the recording medium 20 with the application of heat and pressure becoming a permanent image. Meanwhile, the particles of the toner T on the photosensitive drum 1, which were not transferred onto the recording medium 20, that is, the residual toner particles on the photosensitive drum 1, are removed by the cleaning blade 10, and are collected in the waste toner container 6. Thereafter, the peripheral surface of the photosensitive drum 1 is again charged by the charging apparatus 2 to be subjected to the above described processes.

Next, the memory medium, or a memory, for a process cartridge installable in the above described process cartridge, will be described.

In the case of this embodiment, the cartridge C is provided with a memory 22, and a communicating section 23 for controlling the processes of reading from, and writing into, the memory 22. The communicating section 23 is located on the downwardly facing surface of the bottom wall of the waste toner container 6. The communicating section 23 on the cartridge side and a control section 24 on the image forming apparatus main assembly side are positioned in such a manner that as the cartridge C is installed into the image forming apparatus main assembly 100, they face each other. The control section 24 ion the main assembly side is given a function to double as the transmitting section.

As for the memory 22 to be used with the present invention, there is no restriction; it may be any ordinary semiconductor electronic memory. However, a noncontact memory enabled to be read or written by an IC through electromagnetic wave transmission is preferable, because the employment of such a memory makes unnecessary the physical contact between the communicating section on the cartridge side and the control section on the apparatus main assembly side, eliminating therefore the possibility of contact failure which might result from the way the cartridge C is installed. As a result, it becomes possible to carry out highly reliable control.

The combination of the control section 24 and the communicating section 23 constitutes the control-communicating means for reading information from, or writing information into, the memory 22. The capacity of the memory 22 should be large enough to store a plurality of data, for example, cartridge identification data, which will be described later, or the values which represent the characteristics of each cartridge.

Further, according to the present invention, the amount of the usage of the cartridge C is continuously recorded. There is no specific restriction regarding the type of the value which represents the amount of the cartridge usage stored in the memory 22 as long as it can be usable for the image forming apparatus to determine the amount of cartridge usage. For example, it may be the length of the rotation time of each element in the cartridge, the length of the bias application time, the amount of the remaining toner, the print count, the number of image dots formed on the photosensitive drum 1, the cumulative length of time the laser beam is emitted to expose the photosensitive drum 1, the thickness of the photosensitive layer of the photosensitive drum 1, and a weighted combination of the preceding factors.

Further, cartridge specifications which represent specific properties of each cartridge may be used as parameters for adjusting processing conditions, and they may be those attached to each cartridge when it is shipped from a factory. For example, they may be lot numbers of the photosensitive drum 1, the toner T, the development sleeve 5, and the charge roller 2, the specific value representing the sensitivity of the photosensitive drum 1, the threshold value, and the coefficient pertaining to the equation weighted by the lengths of the charge-bias application time and the photosensitive-drum driving time.

The processing conditions are controlled based on the relationship between the two sets of information stored in the memory 22. More specifically, the data within the memory 22 are computed by the control section 24 on the apparatus main assembly side, and the resultant electrical signals are sent to appropriate processing units to change the high voltage output, the processing speed, the amount of laser light, and the like.

Next, the controlling of the processing condition, that is, the image forming conditions, in this embodiment will be described.

In this embodiment, an AC application system is employed along with the charge roller 2 as a charging means. Thus, negative and positive voltages are alternately applied, triggering electrical discharge in alternating directions. This electrical discharge seriously deteriorates the peripheral surface of the photosensitive drum 1 as an object to be charged, and the deteriorated portions of the peripheral surface of the photosensitive drum 1 are shaved away due to the friction between the peripheral surface of the photosensitive drum 1 and the member such as the cleaning blade 10 which comes into contact with the peripheral surface of the photosensitive drum 1.

Consequently, the photosensitive layer of the photosensitive drum 1 becomes gradually thinner with the apparatus usage. As the thickness of the photosensitive layer of the photosensitive drum 1 becomes less than a certain value, the photosensitive layer becomes inferior in its function. For example, the peripheral surface of the photosensitive drum 1 fails to be uniformly charged, displaying microscopic irregularities in terms of potential level, or reduces in the capacity to hold electrical charge, sometimes failing to be charged. Therefore, the length of the service lives of the image forming apparatus or a process cartridge corresponds to the print count, which accumulates before the thickness of the photosensitive layer reduces to its limit.

It has been known that if the amount of the electrical discharge is reduced below a certain level, electrical discharge becomes unstable, and as a result, so-called sandy patches, that is, areas covered with minute black dots, appear in the resultant image. More specifically, a sandy patch means an image area covered with black dots, in an image outputted through a reversal development process, the positions of which correspond to the areas of the peripheral surface of the photosensitive drum 1 insufficiently charged because the amount of the electrical discharge caused by the charge roller 2 was too small. It has been known that the sandy patches are more apparent when the peak-to-peak voltage of the oscillating voltage applied to the charge roller 2 is small.

Thus, in order to maintain high image quality without sacrificing the length of the service lives of an image forming apparatus and a process cartridge, it is necessary that the photosensitive layer of the photosensitive drum 1 is thick enough to maintain the sharpness of a latent image, and the amount of electrical discharge is exact; in other words, it is not small enough to cause the sandy patch traceable to the insufficiency In the amount of electrical discharge to appear, and yet not large enough to accelerate the deterioration of the photosensitive layer.

As for the method for controlling the voltage applied to a contact charging member such as the charge roller 2, a conventional method for keeping constant the amount of the current which flows from the charge roller 2 to the photosensitive drum 1 is employed.

Shown below are the results of the tests conducted to study the relationship between the shaved amount of the photosensitive material and the total amount of the charge current, and the relationship between the total amount of the current necessary to prevent the appearance of the sandy patches and the print count.

Figure 3:
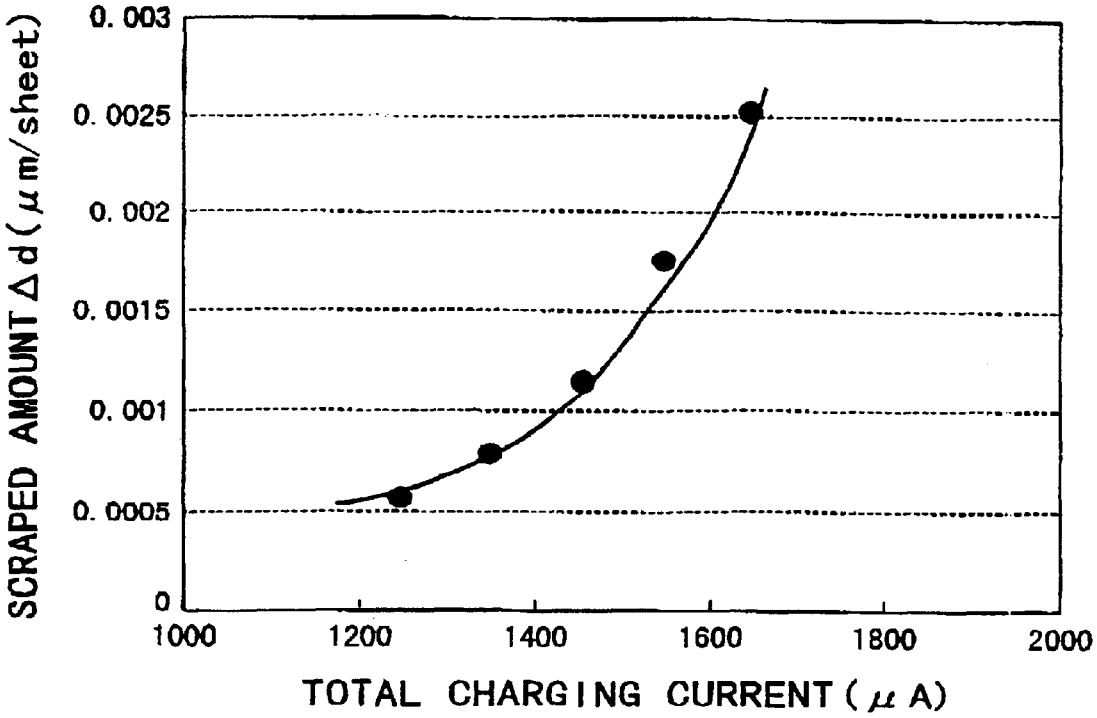
FIG. 3 is a graph which shows the relationship between the total amount of the charge current and the shaved amount of the photosensitive member, in the first embodiment of the present invention.

FIG. 3 shows the relationship between the shaved amount $\Delta d$ ($\mu$m/print count) of the photosensitive member and the total amount of the charge current $I_{total}$ per unit of time. It is evident from FIG. 3 that the smaller the total amount of the charge current, the smaller the shaved amount of the photosensitive material.

Incidentally, a thickness d of the photosensitive layer represents the actual thickness of the photosensitive layer measured using a film thickness gauge (Permascope E-1: product of Fischer).

Figure 4:
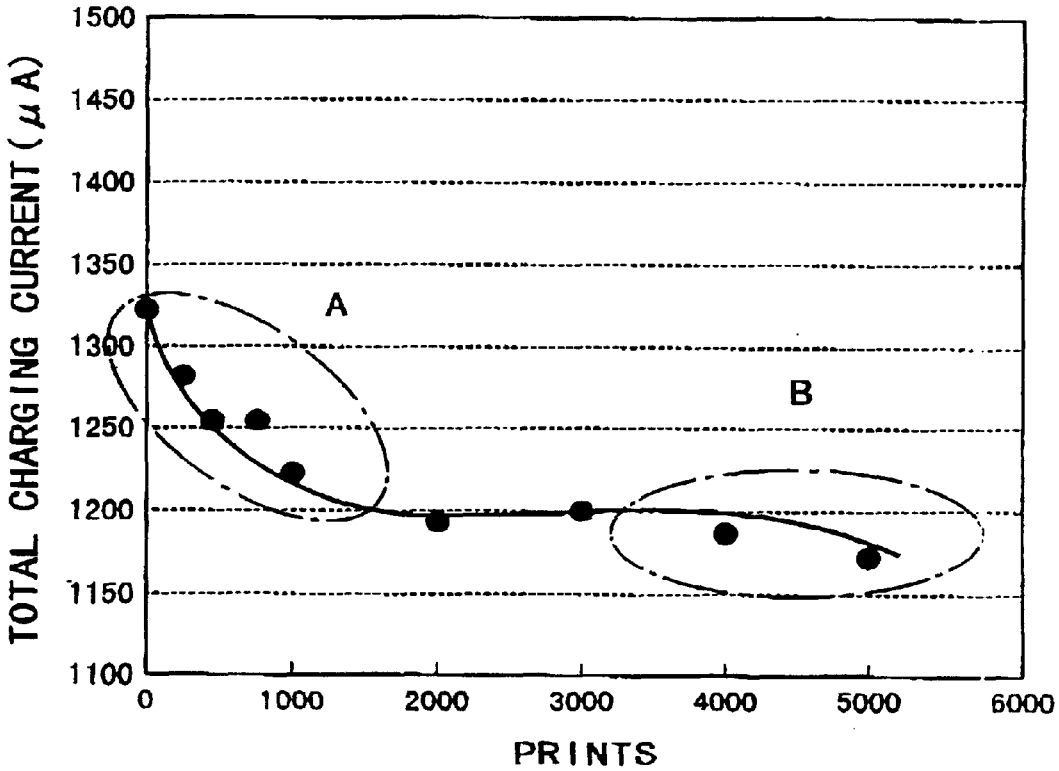
FIG. 4 is a graph which shows the relationship between the number of the prints produced and the total amount of the charge current, in the first embodiment of the present invention.

FIG. 4 shows the relationship between the print count and the total amount of the charge current $I_{total}$ corresponding to the nonappearance of the sandy patches. It is evident from FIG. 4 that there are changes in the total amount of the charge current in regions A and B. It may be thought that these changes, that is, the appearance of the sandy patches, are traceable to the charge roller 2, and the thickness of the surface layer of the photosensitive drum 1.

The dominant cause of the charges in the region A is charge roller 2. More specifically, as the print count increases, the charge roller 2 is contaminated with the external additive of the toner, the reversely charged toner, and paper dust, being changed in charging performance; in other words, the total amount of the charge current per unit of time is reduced.

In the region B, the dominant cause of the changes is the photosensitive member. More specifically, each time a printing cycle is repeated, the peripheral surface of the photosensitive member is shaved by a small amount; the photosensitive layer, that is, the surface layer of the photosensitive member, becomes thinner. As the photosensitive layer becomes thinner, the impedance of the photosensitive member is reduced, increasing the voltage applied to the photosensitive drum when charging the photosensitive drum. As a result, it becomes easier for electric discharge to occur. Consequently, the total amount of the charge current per unit of time decreases.

As is evident from the above description, in order to extend the service life of the photosensitive member without sacrificing image quality, it is best to set the total amount of the charge current at the minimum value which does not deleteriously affect image quality. For the purpose, the charge current value must be set in consideration of both the condition of the charge roller 2, and the thickness of the photosensitive layer of the photosensitive drum 1.

The condition of the charge roller 2 and the thickness of the photosensitive layer of the photosensitive drum 1 are dependent upon the characteristics of the various components in a cartridge, and the amount of their usage. Thus, in this embodiment:

(1) The process cartridge C is provided with the memory 22, so that the amount of usage can be computed using a equation weighed by the length of time the charge bias is applied, and the length of time the photosensitive drum 1 is driven. Hereinafter, the amount of usage obtained in the above described manner will be called "drum usage data".

(2) The threshold values pertaining to the drum usage data determined by the characteristics of the photosensitive drum 1 and charge roller 2, and the coefficient pertaining to the drum usage data computing equation, are stored in the memory 22.

(3) The amount of the cartridge usage is computed based on the length of time the charge bias is applied, the length of time the photosensitive drum 1 is driven, which are measured by the image forming apparatus main assembly 100, and the coefficient, and as the value of the thus obtained amount of the cartridge usage reaches the threshold value stored in the memory 22, the charge current value is switched. With this control, it is possible to charge the photosensitive drum 1 using as small as an amount of charge current as possible without sacrificing image quality, regardless of the differences among cartridges, and also regardless of the print count. Consequently, the service life of the photosensitive drum 1 can be extended.

Next, referring to FIGS. 5 and 6, the memory controlling structure in this embodiment will be described.

Figure 5:
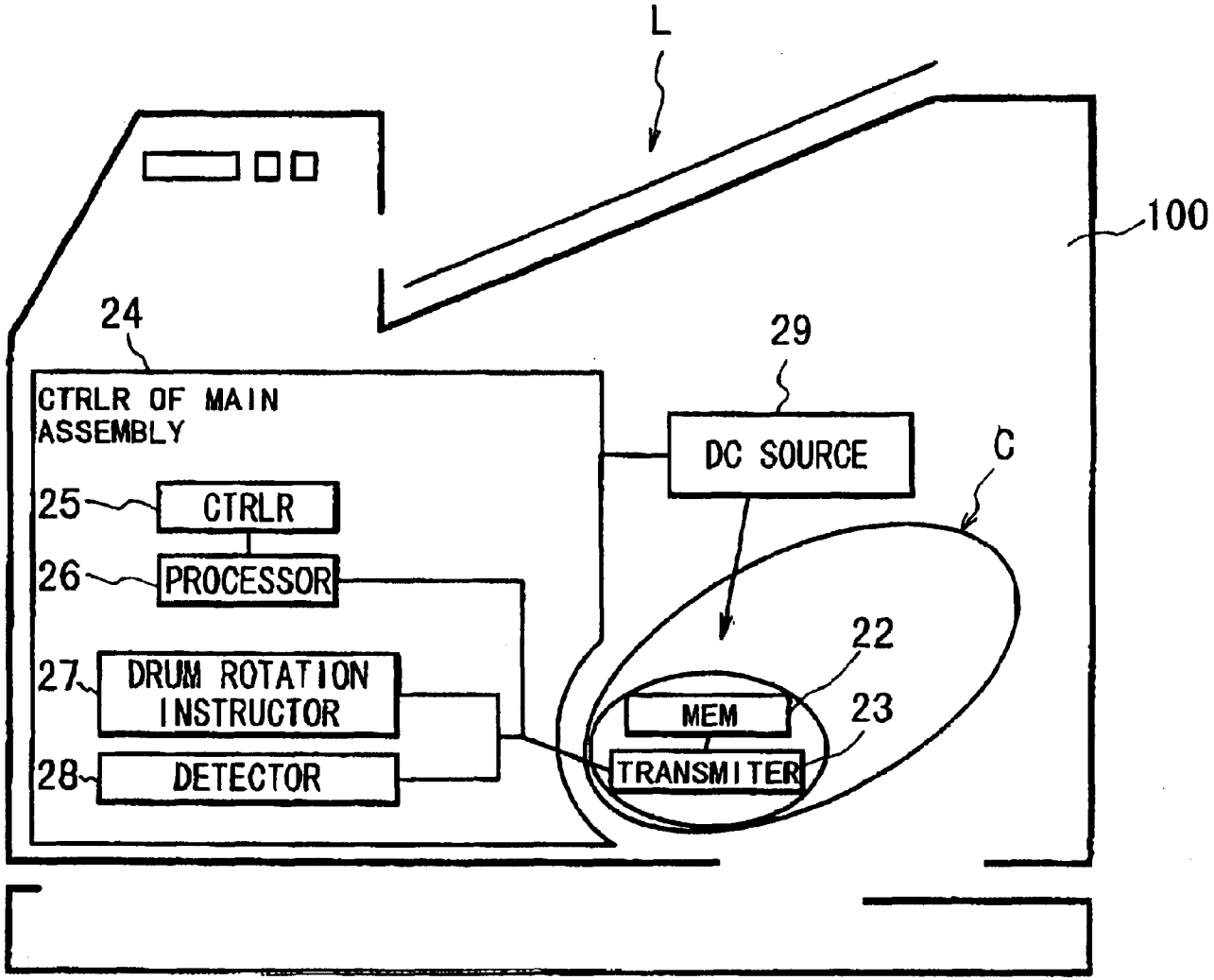
FIG. 5 is a block diagram which shows the relationship between the information control section on the main assembly side, and the memory, of the image forming apparatus in the first embodiment of the present invention.

As shown in FIG. 5, the cartridge C side is provided with the memory 22 and communicating section 23, whereas the apparatus main assembly side is provided with control section 24 which comprises a control portion 25, a computing portion 26, a photosensitive member rotation control portion 27, a charge bias application time detecting portion 28, and the like.

Figure 6:
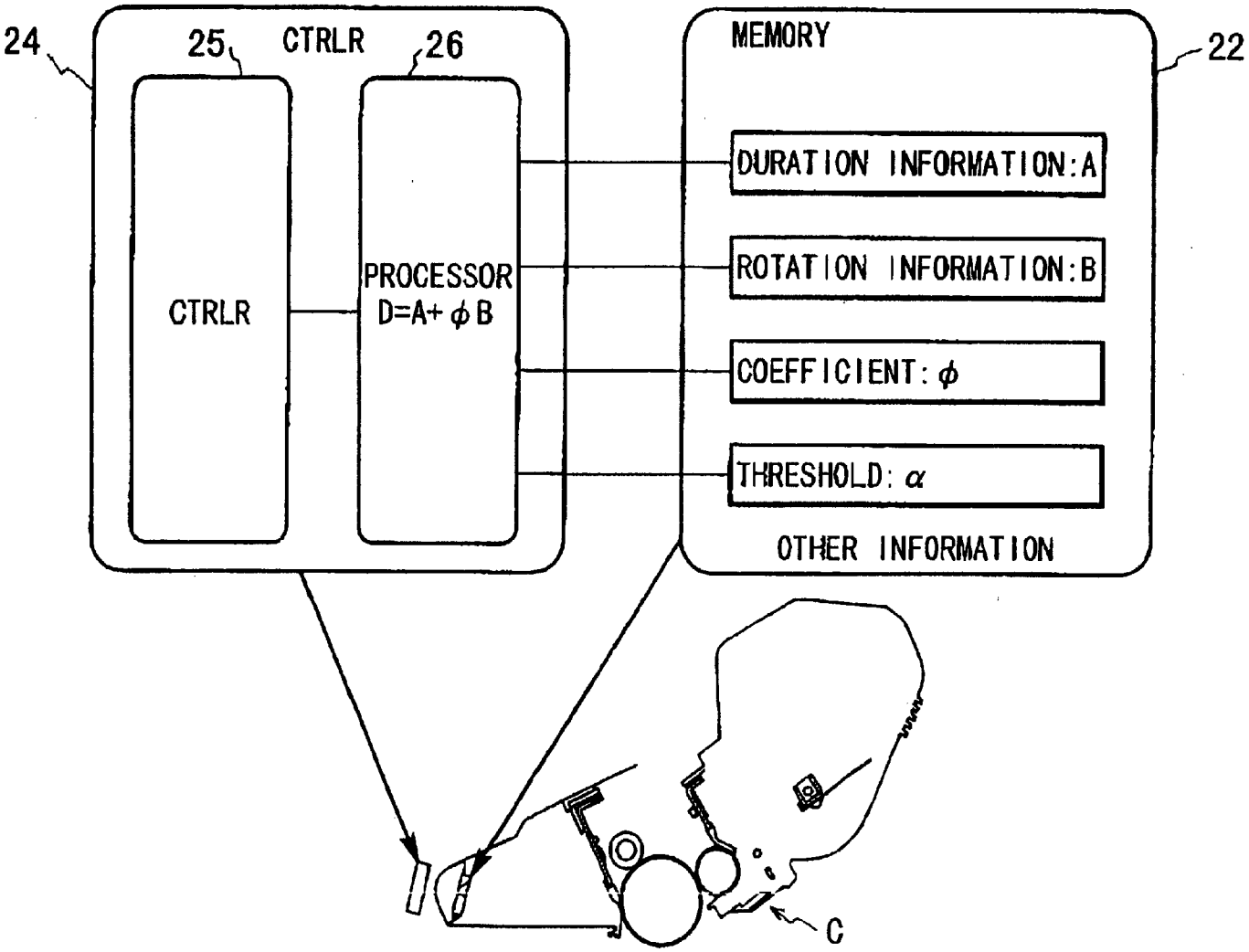
FIG. 6 is a block diagram which shows the relationship between the control section on the main assembly side, and the information within the memory, in the image forming apparatus in the first embodiment of the present invention.

FIG. 6 shows the information stored in the memory 22. Although there are various kinds of information storable in the memory 22, it is assumed that, in this embodiment, at least, the following information is stored: information A or the length of time the charge bias was applied; information B or the length of time the photosensitive member was rotated; coefficient ø pertaining to the drum usage amount computing equation; and α (information regarding timing) or the threshold value pertaining to the drum usage amount computing equation. The threshold value and coefficient change depending on the sensitivity, the material, and the thickness at the time of production, of the photosensitive drum 1, and the characteristics of the charge roller 2, and therefore, values in accordance with these factors and characteristics are written into the memory 22 at the time of cartridge manufacture.

The information in the memory 22 is rendered always transmittable between the memory 22 and the computing portion 26 of the control section 24 on the main assembly side. The computation is carried out based on the above listed information, and the results of the computation are compared to the stored data by the control portion 25.

Next, the method for computing the drum usage data, in this embodiment will be described.

The drum usage data D is computed by the computing portion 26 using the information B or data representing the cumulative length of time the photosensitive member was rotated, which is obtained from the photosensitive member rotation control portion 27, the information A or the cumulative length of time the charge bias was applied, which is obtained from the charge bias application time detecting portion 28, and a conversion equation: $D=A+(B\times ø)$, which is weighted by the coefficient ø. The results are stored in the memory 22 of the process cartridge C.

Incidentally, the data regarding the length of the photosensitive member rotation time, and the data regarding the length of the charge bias application time, are continuously stored in the memory 22, and the drum usage data are computed whenever the driving of the photosensitive drum 1 is stopped.

Figure 7:
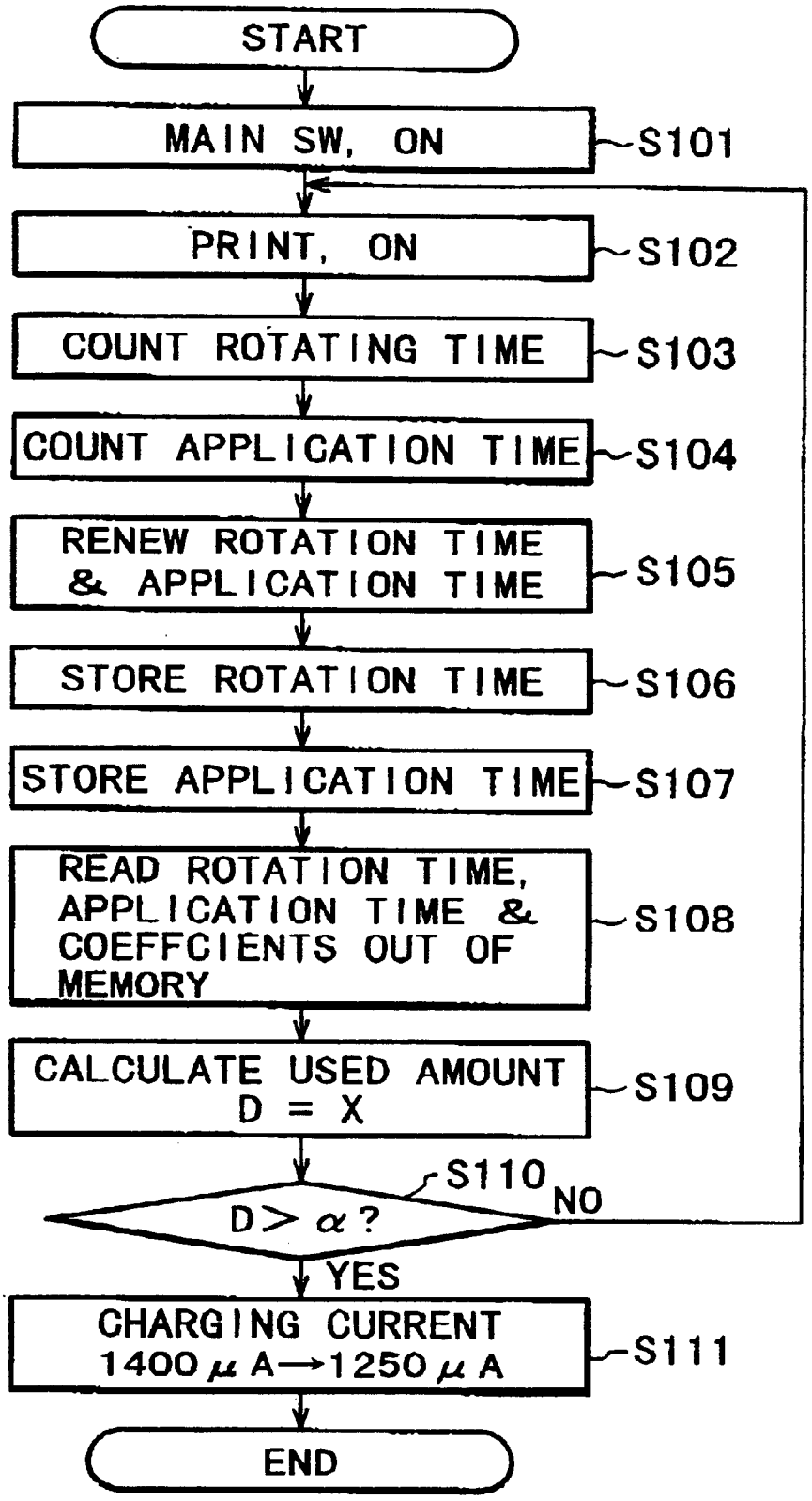
FIG. 7 is a flow chart of the image forming operation in the first embodiment of the present invention.

Next, referring to the flow chart in FIG. 7, the operation of the image formation apparatus in this embodiment will be described.

First, the operation of the image forming apparatus is started (START), and each of the following steps S101–S111 is carried out:

S101: the power source of the image forming apparatus main assembly is turned on;

S102: a print-ON signal is transmitted from the control portion 25;

S103: the photosensitive member rotation time detecting section 27 begins to count the length of the photosensitive member rotation time;

S104: the charge bias application time detecting portion 28 begins to count the length of the charge bias application time;

S105: the cumulative length of the photosensitive member rotation time, and the cumulative length of the charge bias application time, which were read out of the memory 22 in the process cartridge C, are updated;

S106: the updated cumulative length of the photosensitive member rotation time is stored in the memory 22 of the process cartridge C;

S107: the updated cumulative length of the charge bias application time is stored in the memory 22 on the process cartridge C;

S108: the control portion 25 reads out the cumulative length of the photosensitive member rotation time, the cumulative length of the charge bias application time, and the coefficient pertaining to the drum usage amount data computing equation, from the memory 22;

S109: the computing portion 26 computes the drum usage data from the cumulative lengths of the photosensitive member rotation time and charge bias application time;

S110: the control portion 25 determines whether or not the computed drum usage data reached the threshold value a (information related to timing) stored in the memory 22. If the answer is "YES", a step S111 is taken, whereas if the answer is "NO", the sequence from S105 to S110 is repeated; and

S111: a switching signal is transmitted from the control portion 25 to the charge bias power source 29 illustrated in FIG. 5, to change the charge current value. In this embodiment, as the threshold value $\alpha$ is reached, the charge current value, which is 1400 $\mu$A is switched to 1250 $\mu$A.

This concludes the control operation (END).

Figure 8:
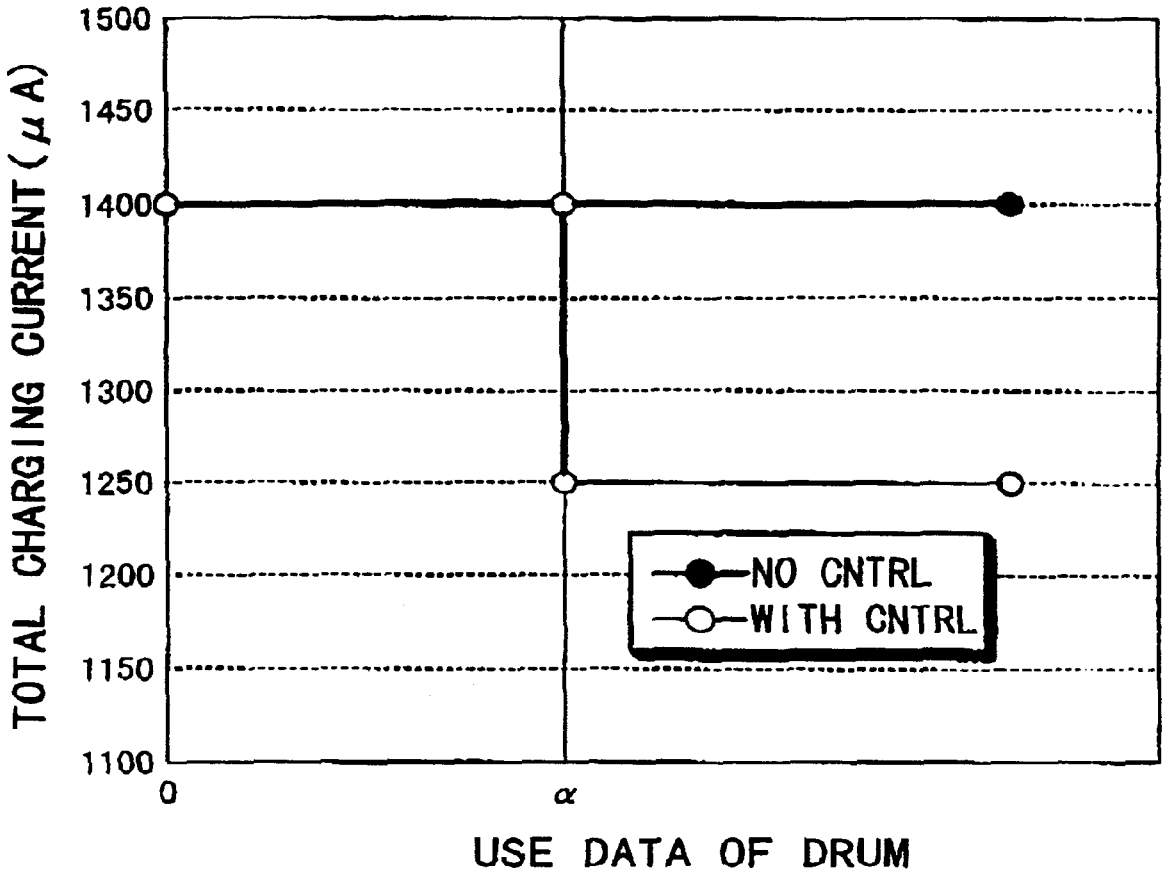
FIG. 8 is a graph which shows the relationship between the drum usage amount data and total amount of the charge current, in the first embodiment of the present invention.
Figure 9:
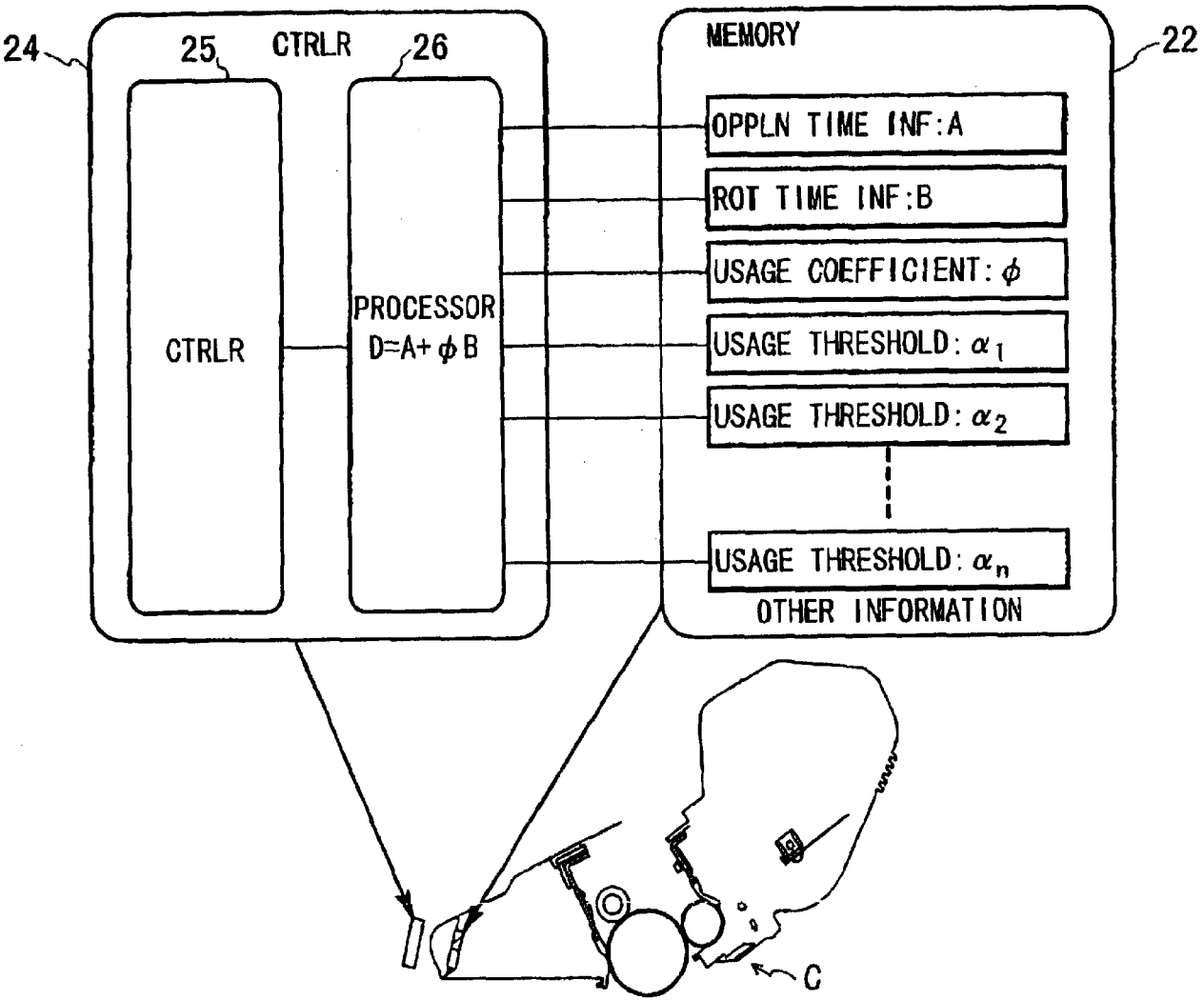
FIG. 9 is a block diagram which shows the relationship between the control portion on the main assembly side, and the information in the memory, when there are a plurality of threshold values pertaining to the drum usage amount computing equation, in the first embodiment of the present invention.

When the current value was controlled as shown by the above described flow chart, and the solid line in FIG. 8, the length of the service life of the photosensitive drum 1, which used to be 13000 in terms of print count, could be extended to 17000. In other words, according to the present invention, it becomes possible to use as small an amount of charge current as possible while maintaining image quality, so that the service life of the photosensitive drum 1 can be extended.

Although current switching is done only once in this embodiment, it may be done in a plurality of steps depending on the characteristics of individual cartridges. Further, the current value may be raised or lowered depending on the condition of each cartridge. Also, two or more drum usage data threshold values may be used, although only one is used in this embodiment. The threshold value varies depending on various factors, for example, the difference in the manufacture lot, and therefore, the threshold value stored in each cartridge in this embodiment is selected to reflect these factors, so that image quality can be maintained regardless of differences among cartridges and the length of their usage.

FIG. 6 shows the information within the memory 22 when a plurality of drum usage data threshold values are used. At least the following kinds of information are stored in the memory 22: information A or the length of time the charge bias was applied; information B or the length of time the photosensitive member was rotated; coefficient $\phi$ pertaining to the drum usage amount data computing equation; and $\alpha 1$, $\alpha 2$, . . . $\alpha_n$ or the threshold values pertaining to the drum usage amount data computing equation, although there are various other kinds of information stored therein. The information in the memory 22 is rendered constantly transmittable between the memory 22 and the computing portion 26 within the control section 24 on the main assembly side. The results of the computation carried out based on these data are compared to the referential data by the control portion 25.

Figure 10:
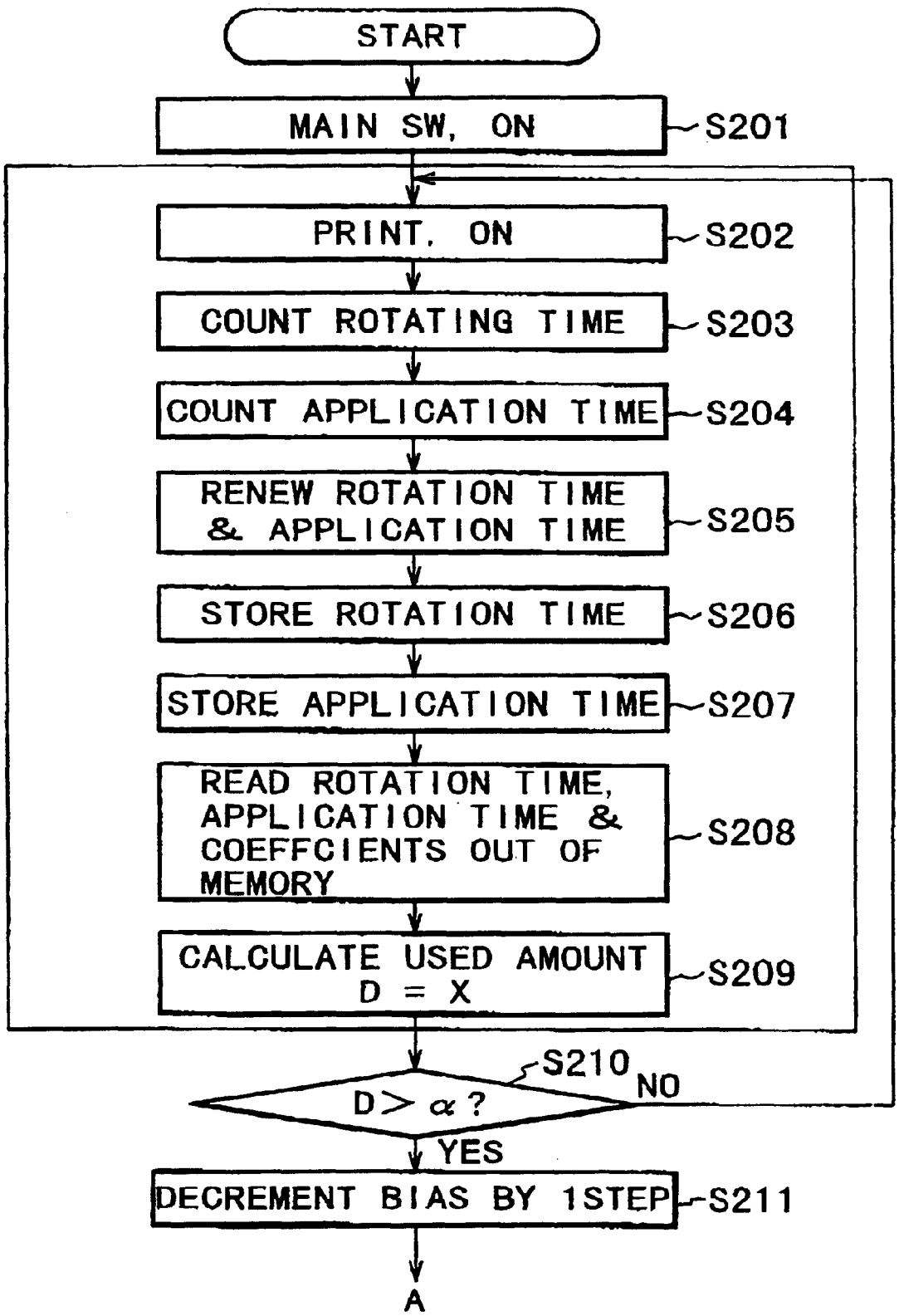
FIG. 10 is a flow chart for the image forming operation when there are a plurality of threshold values pertaining to the drum usage amount computing equation, in the first embodiment of the present invention.
Figure 11:
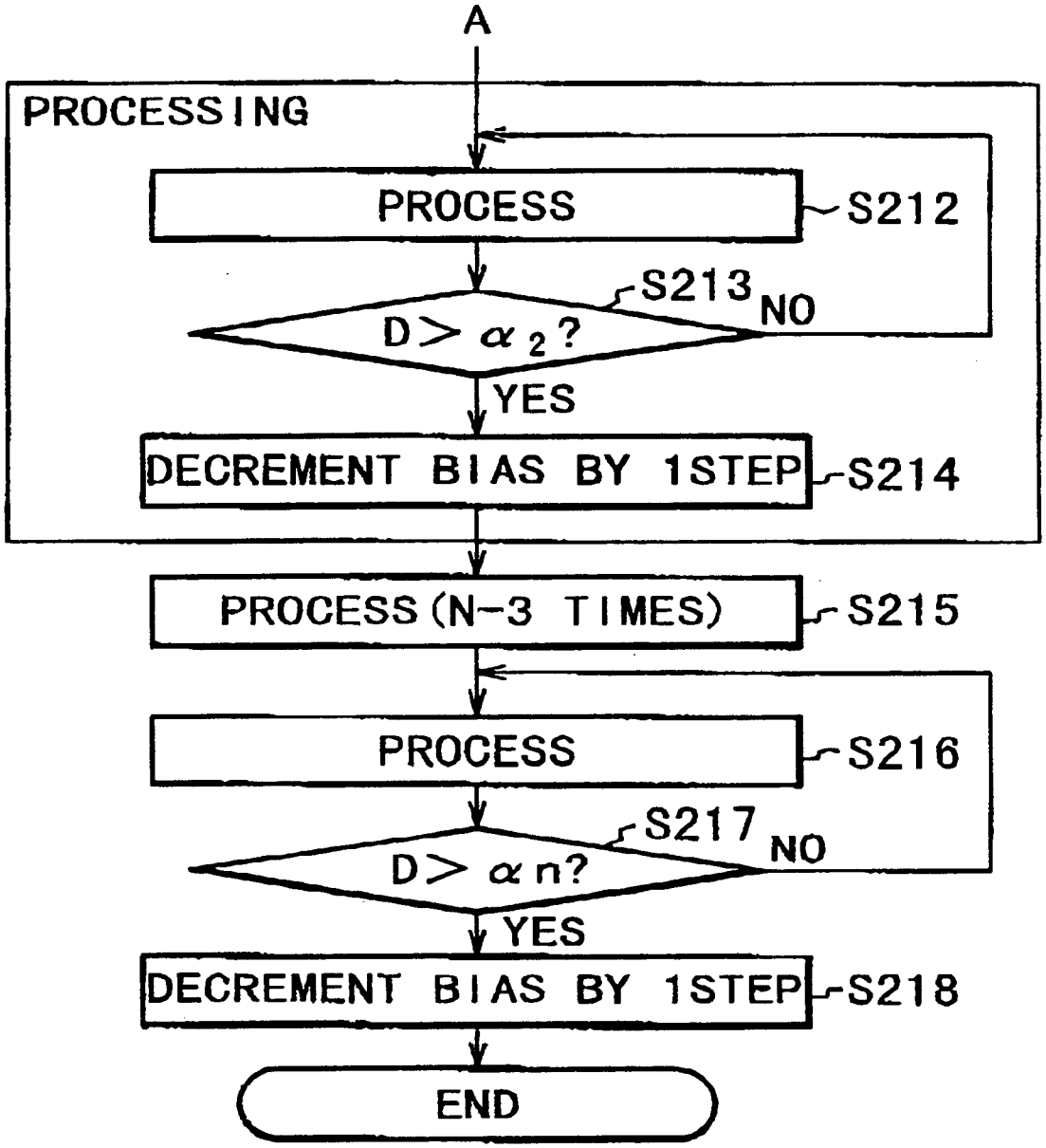
FIG. 11 is a flow chart for the image forming apparatus when there are a plurality of threshold values pertaining to the drum usage amount computing equation, in the first embodiment of the present invention.

FIGS. 10 and 11 show the flow chart for switching the current value twice or more.

The operation of the image forming apparatus is started (START), and the following steps S201–S218 are carried out:

S201: the power source of the image forming apparatus main assembly is turned on;

S202: a print-ON signal is transmitted from the control portion 25;

S203; the photosensitive member rotation time detecting section 27 begins to count the length of the photosensitive member rotation time;

S204: the charge bias application time detecting portion 28 begins to count the length of the charge bias application time;

S205: the cumulative length of the photosensitive member rotation time, and the cumulative length of the charge bias application time, which were read out of the memory 22 in the process cartridge C, are updated.

S206: the updated cumulative length of the photosensitive member rotation time is stored in the memory 22 of the process cartridge C;

S207: the updated cumulative length of the charge bias application time is stored in the memory 22 of the process cartridge C;

S208: the control portion 25 read out the cumulative length of the photosensitive member rotation time, the cumulative length of the charge bias application time, and the coefficient pertaining to the drum usage amount data computing equation, from the memory 22;

S209: the computing portion 26 computes the drum usage data from two parameters (hereinafter, the steps S202–S209 will be referred to as "computation steps");

S210: the control portion 25 determines whether or not the computed drum usage data reached the threshold value $\alpha$ stored in the memory 22. If the answer is "YES", a step S211 is taken, whereas if the answer is "NO", the operation goes back to S205; and

S211: the bias designation in the bias table stored in advance in the control portion 25 is lowered by one unit of change, and a switching signal is transmitted from the control portion 25 to the charge bias power source 29 illustrated in FIG. 5, to change the charge current value;

S212: computation is carried out in the memory 22, and also in the control section 24 on the main assembly side;

S213: the control portion 25 determines whether or not the computed drum usage data reached the threshold value $\alpha 2$ stored in the memory 22. If the answer is "YES", the operation advances to S214, whereas if the answer is "NO", the operation returns to S212.

S214: the bias designation in the bias table stored in advance in the control portion 25 is lowered by one unit of change, and a switching signal is transmitted from the control portion 25 to the charge bias power source 29 illustrated in FIG. 5, to change the charge current value (hereinafter, the sequence S212–S214 will be called "processing sequence");

S215: the processing sequence is repeated for (N-3) times;

S216: computation is carried out in the memory 22, and in the control section 24 on the main assembly side;

S217: the control portion 25 determines whether or not the computed drum usage data reached the threshold value $\alpha_n$ stored in the memory 22. If the answer is "YES", the operation advances to S218, whereas if the answer is "NO", the operation returns to S216;

S218; the bias designation in the bias table stored in advance in the control portion 25 is lowered by one unit of change, and a switching signal is transmitted from the control portion 25 to the charge bias power source 29 illustrated in FIG. 5, to change the charge current value.

This concludes the control operation (END).

Embodiment 2

Next, the second embodiment of the present invention will be described. The structures of the image forming apparatus and process cartridge in the second embodiment are the same as those in the first embodiment. Therefore, their description will be omitted, and only their distinctive features will be described.

In the first embodiment, the amount of the charge current was varied based on the cumulative length of the usage time of the photosensitive drum 1 as the process cartridge C usage data to be stored in the memory 22 in the process cartridge C, and two characteristic values, that is, the threshold value pertaining to the amount of the usage of the photosensitive drum 1, and the coefficient. This embodiment is distinctive in that another characteristic value which represents the information regarding the sensitivity of the photosensitive drum 1 is employed in addition to the data relied upon in the first embodiment, and the DC voltage applied to charge the photosensitive drum 1, and the DC voltage applied for development, are varied based on these data.

Figure 12:
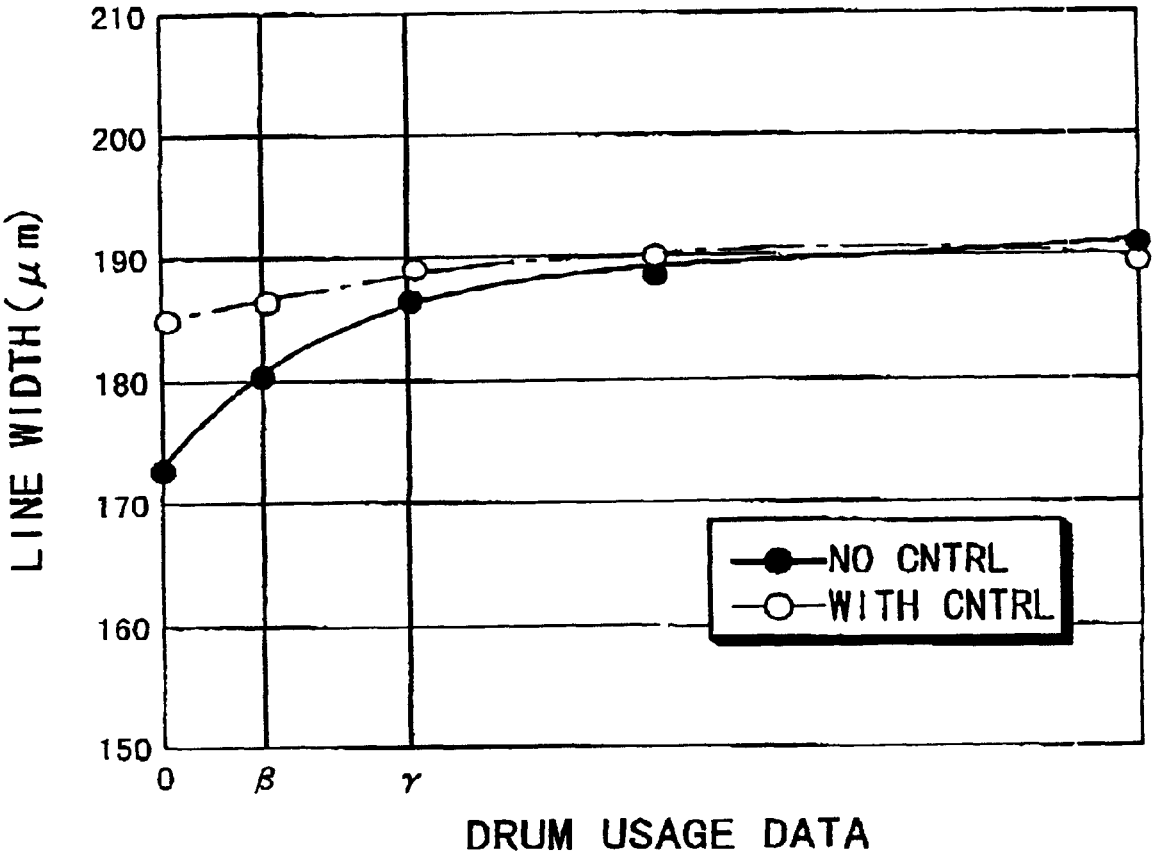
FIG. 12 is a graph which shows the drum usage amount data and line width, in the second embodiment of the present invention.

It has been known that there is a tendency that the line width in a print produced when a developing device is in its early stage of usage (when a relatively larger amount of toner is in the developing device) is less than the line width in a print produced when the developing device is in an advanced stage of usage. FIG. 12 shows the changes which occur to the actual width of a line in an image with a resolution of 600 dpi, the theoretical width of which corresponds to 4 dots, as a printing operation continues. Following the solid line in the graph reveals that the actual line width keeps on increasing during the initial period of the operation, that is, while printing the first 1000 copies.

Although various causes are conceivable for this phenomenon, it may be listed as the primary cause that the amount of the toner charge, and the potential level Vl of the photosensitive drum, are unstable in the initial period of the operation. In other words, since the potential level VL is affected by the selection of a sheet feeding mode, and the resultant latent image is faithfully reproduced, the line tends to become narrower in the initial period in which fluctuation in potential level VL is greater. Further, there is a substantial amount of difference in the sensitivity of the drum, that is, the potential level VL, among the groups of process cartridge different in lot number.

Thus, in this embodiment:

(1) The process cartridge C is provided with the memory, so that the drum usage data can be computed using an equation weighed by the length of time the charge bias is applied, and the length of time the photosensitive drum 1 is rotated.

(2) The threshold values for the drum usage data determined by the characteristics of the photosensitive drum 1 and charge roller 2, and the coefficients pertaining to the equation, and the information regarding the drum sensitivity, are stored in the memory.

(3) DC bias for charge, and DC bias for development, are determined for each cartridge according to the information regarding its drum sensitivity.

(4) Thereafter, the amount of the cartridge usage (drum usage) is computed based on the length of time the charge bias is applied, the length of time the photosensitive drum 1 is driven, which are measured by the image forming apparatus main assembly, and the coefficient, and as the value of the thus obtained amount of the cartridge usage reaches the threshold value stored in the memory, the DC bias for charge and the DC bias for development are switched. With this control, it is possible to minimize the line width change which occurs in the initial period of a printing operation, and therefore, high quality is realized.

Next, referring to FIGS. 13 and 14, the structure for controlling the memory in this embodiment will be described.

Figure 13:
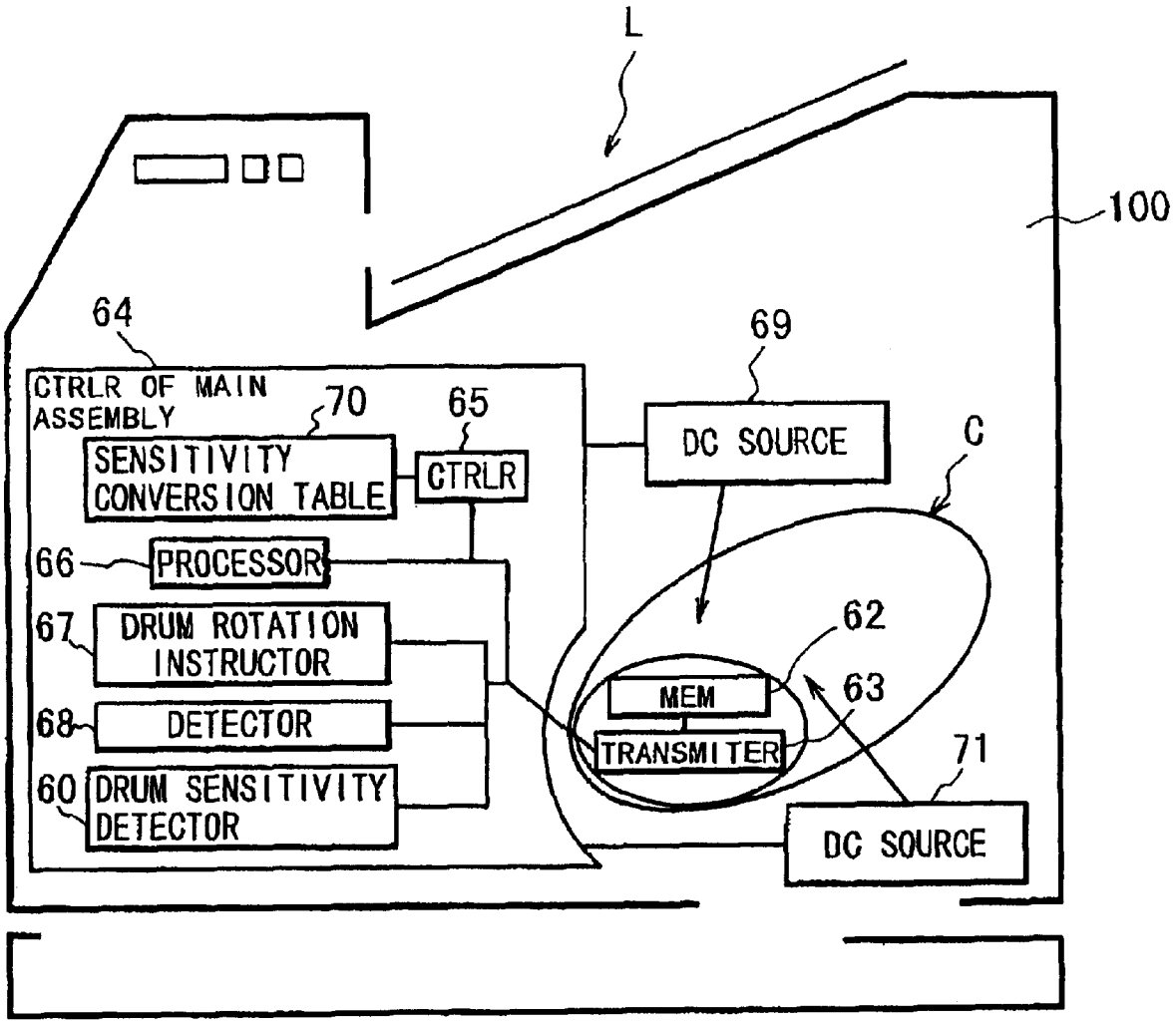
FIG. 13 is a block diagram which shows the relationship between the control section on the main assembly side, and the information in the memory, in the second embodiment of the present invention.

As shown in FIG. 13, the cartridge C is provided with a memory 62 and a communicating portion 63, whereas the apparatus main assembly side 100 is provided with control section 64 which comprises a drum sensitivity detecting means 60, a control portion 65, a computing portion 66, a photosensitive member rotation control portion 67, a charge bias application time detecting portion 68, a sensitivity conversion table 70, and the like.

Figure 14:
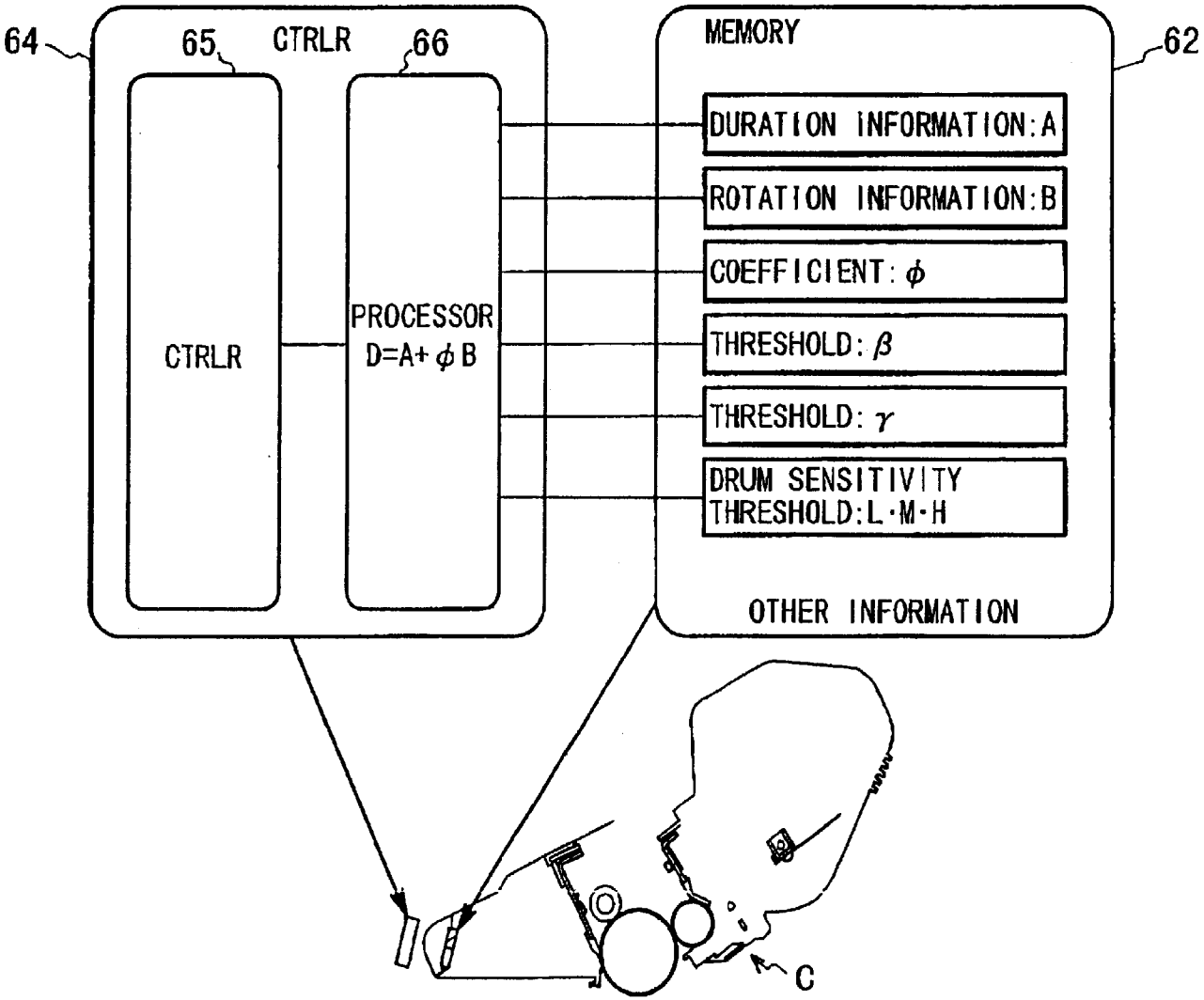
FIG. 14 is a block diagram which shows the control section on the main assembly side and the information in the memory.

FIG. 14 shows the information stored in the memory 62. Although there are various sorts of information storable in the memory 62, at least the following sorts of information are stored in this embodiment: information A or the length of time the charge bias was applied; information B or the length of time the photosensitive member was rotated; coefficient ø for the drum usage amount computing equation: β, γ or the threshold values for the equation for computing the length of drum usage; and L.M.H or drum sensitivity threshold values. The threshold value and coefficient change depending on the sensitivity, material, and thickness at the time of operation, of the photosensitive drum 1, and the characteristics of the charge roller 2, and therefore, values in accordance with these factors and characteristics are written into the memory 62 at the time of cartridge manufacture. These types of information in the memory 62 are rendered always transmittable between the memory 62 and the computing portion 66 of the control section 64 on the main assembly side. The computation is carried out based on these types of information, and the results of the computation are compared to the stored data by the control portion 65.

Next, the method for computing the drum usage data, in this embodiment will be described.

The drum usage data D is computed by the computing portion 66 using the information B or data representing the cumulative length of time the photosensitive member was rotated, which is obtained from the photosensitive member rotation control portion 67, the information A or the cumulative length of time the charge bias was applied, which is obtained from the charge bias application time detecting portion 68, and a conversion equation weighted by a predetermined weighting coefficient $ø=D-A+(B\times ø)$. The results are stored in the memory 62 of the process cartridge C.

Incidentally, the data regarding the length of the photosensitive member rotation time, and the data regarding the length of the charge bias application time, are continuously stored in the memory 62, and the drum usage data are computed whenever the driving of the photosensitive drum 1 is stopped. In this embodiment, two threshold values β and γ are used, and their relationship is: $\beta<\gamma$.

Figure 15:
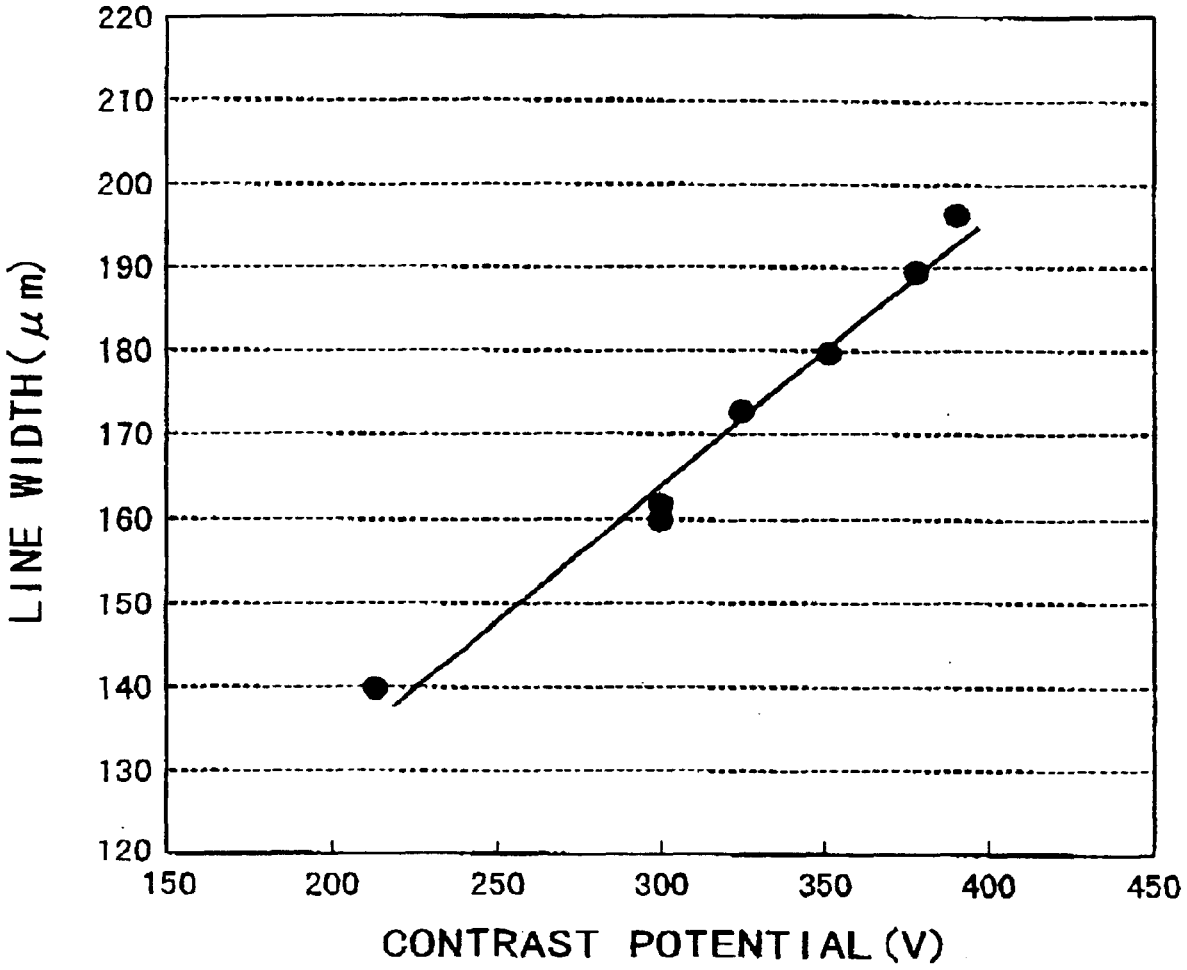
FIG. 15 is a graph which shows the relationship between the development contrast and line width, in the second embodiment of the present invention.

FIG. 15 shows the relationship between the contrast potential level and line width. The contrast potential level means the absolute value of the difference between the potential level of the DC component of development bias, and the potential level VL of the drum.

As is evident from FIG. 15, they show, apparent correlation, and the ratio of the line width change per development DC bias of 10 V is 2–5 (μm/10 V). Therefore, all that is necessary in order to compensate for the line width affected by the sensitivity of the photosensitive drum 1 and the condition of the cartridge C is to control the contrast potential level. In this embodiment, a method for varying the development DC bias and charge DC bias is chosen as a means for varying the contrast potential level.

As the process cartridge C is installed into the image forming apparatus L, the drum sensitivity detecting portion 60 within the control section of the main assembly reads out the sensitivity value in the memory 62. In this embodiment, the drum sensitivity is divided into three ranges, L, M and H, depending on the potential level VL of each photosensitive drum at the time of shipment. The potential level ranges are: $H\geqq-120$ V; $M=-120$ to $-170$ V; and $L\leqq-170$. The charge and development DC voltages are varied according to each of the three drum sensitivity ranges, with reference to the sensitivity conversion table 70 in the control portion 65. Based on the relationship in FIG. 15, the value of the unit (step) by which the development bias is varied is set to 20 V (one unit (step) of change=20 V). In consideration of the fact that the increase in the fog caused by the bias variation must be prevented, it is necessary for both the charge bias and development bias to be varied by a predetermined unit of change, so that back contrast and development contrast remain constant. In this embodiment, in consideration of the values Max and Mini of the maximum and minimum densities, respectively, which can be inputted by a user, the unit (step) value by which the development and charge DC voltages are varied are set as follows: development DC voltage variation unit=−20 V; charge DC voltage variation unit=−10V. As for the development DC voltage, when M=−450 V, the values of L and M are rendered lower or higher than the value of M by a unit of ±20 V, respectively. As for the charge DC voltage, when M=−600 V, the values of L and H are rendered lower or higher than the value of the M by a unit of ±10 V, respectively.

The data regarding the length of the photosensitive member rotation time, and the data regarding the length of the charge bias application time, are to be continuously stored in the memory, and the drum usage data are to be computed whenever the driving of the photosensitive drum 1 is stopped.

Figure 16:
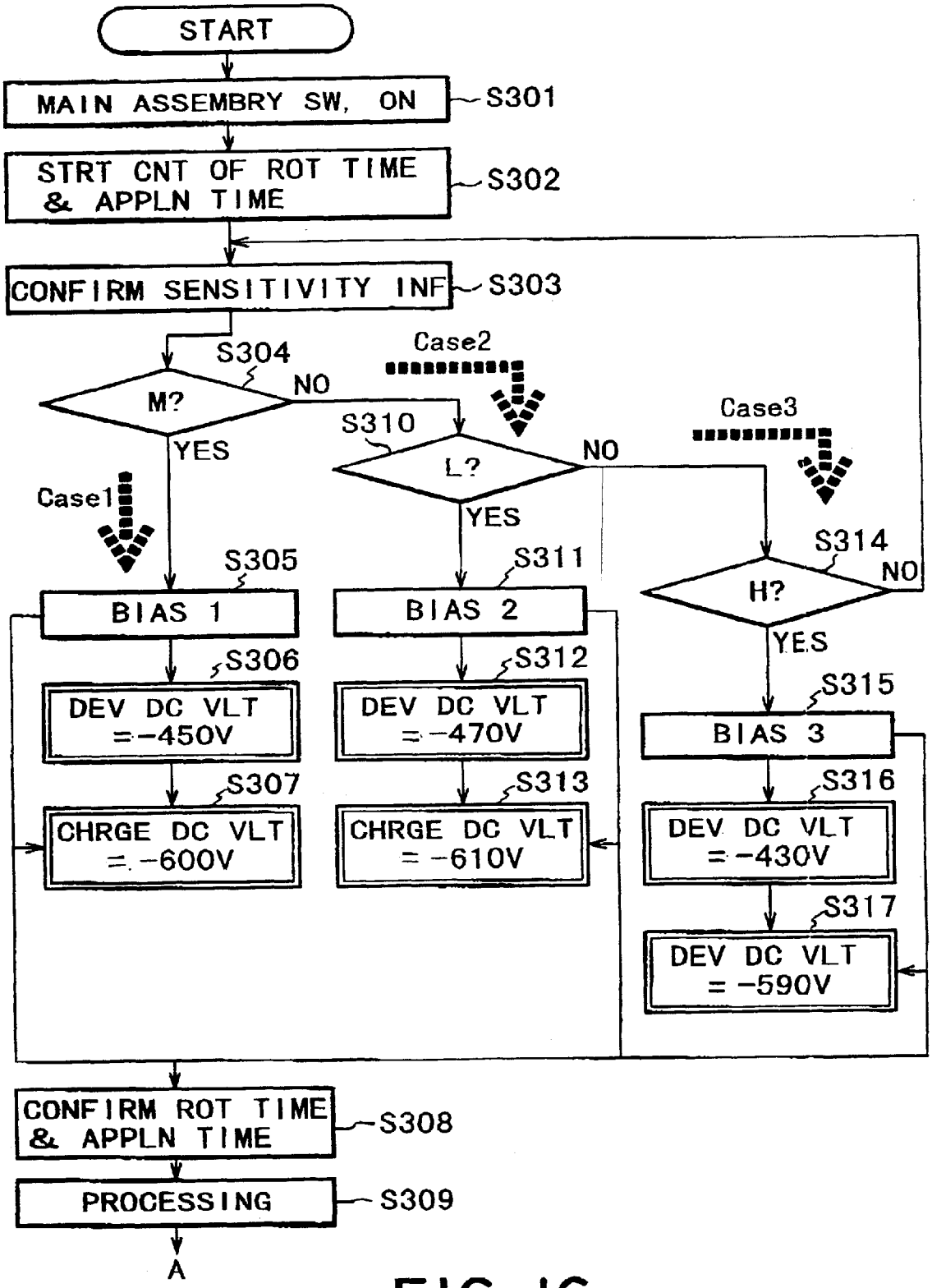
FIG. 16 is a flow chart for the image forming operation in the second embodiment of the present invention.
Figure 17:
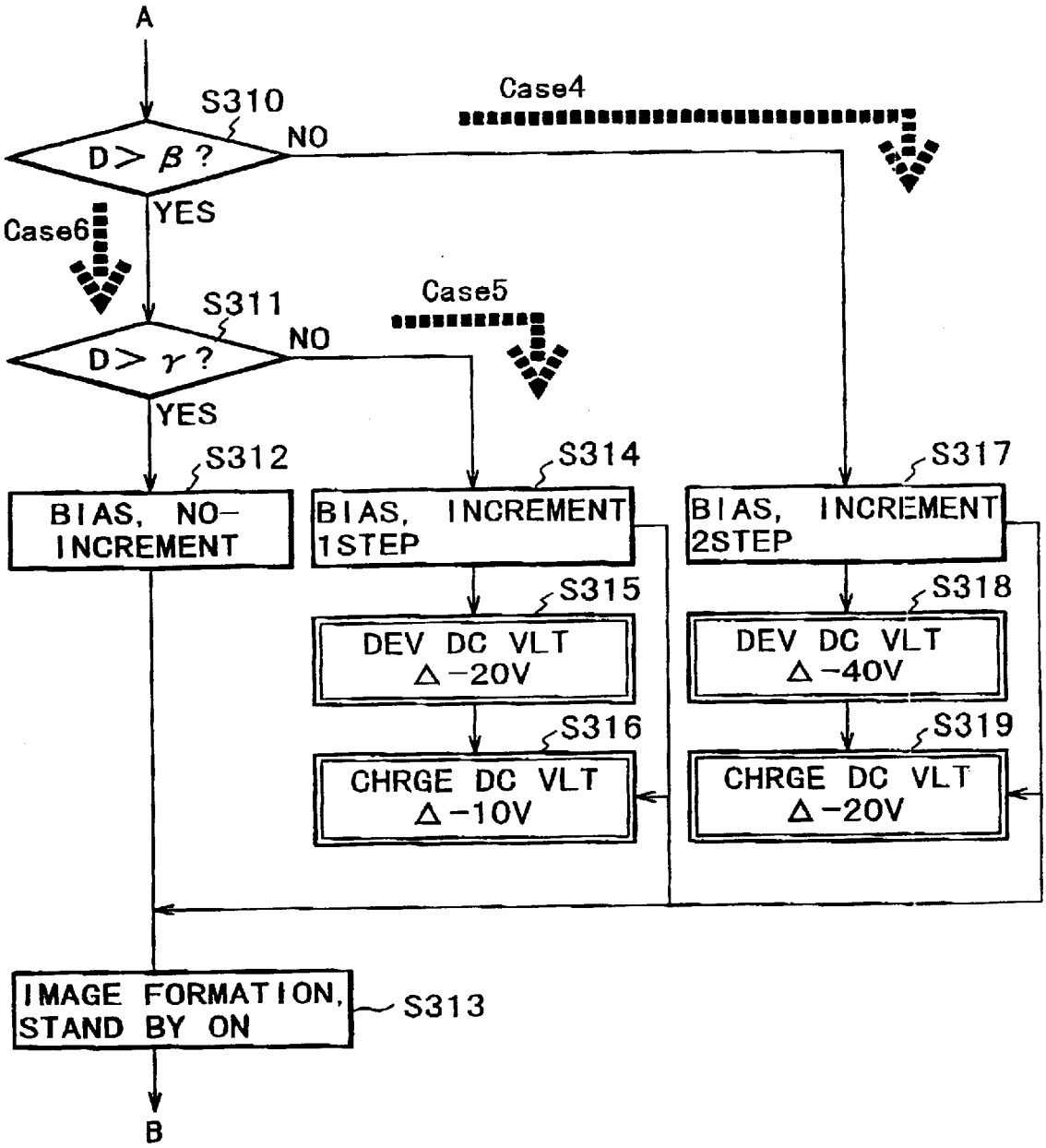
FIG. 17 is a flow chart for the image forming operation in the second embodiment of the present invention.
Figure 18:
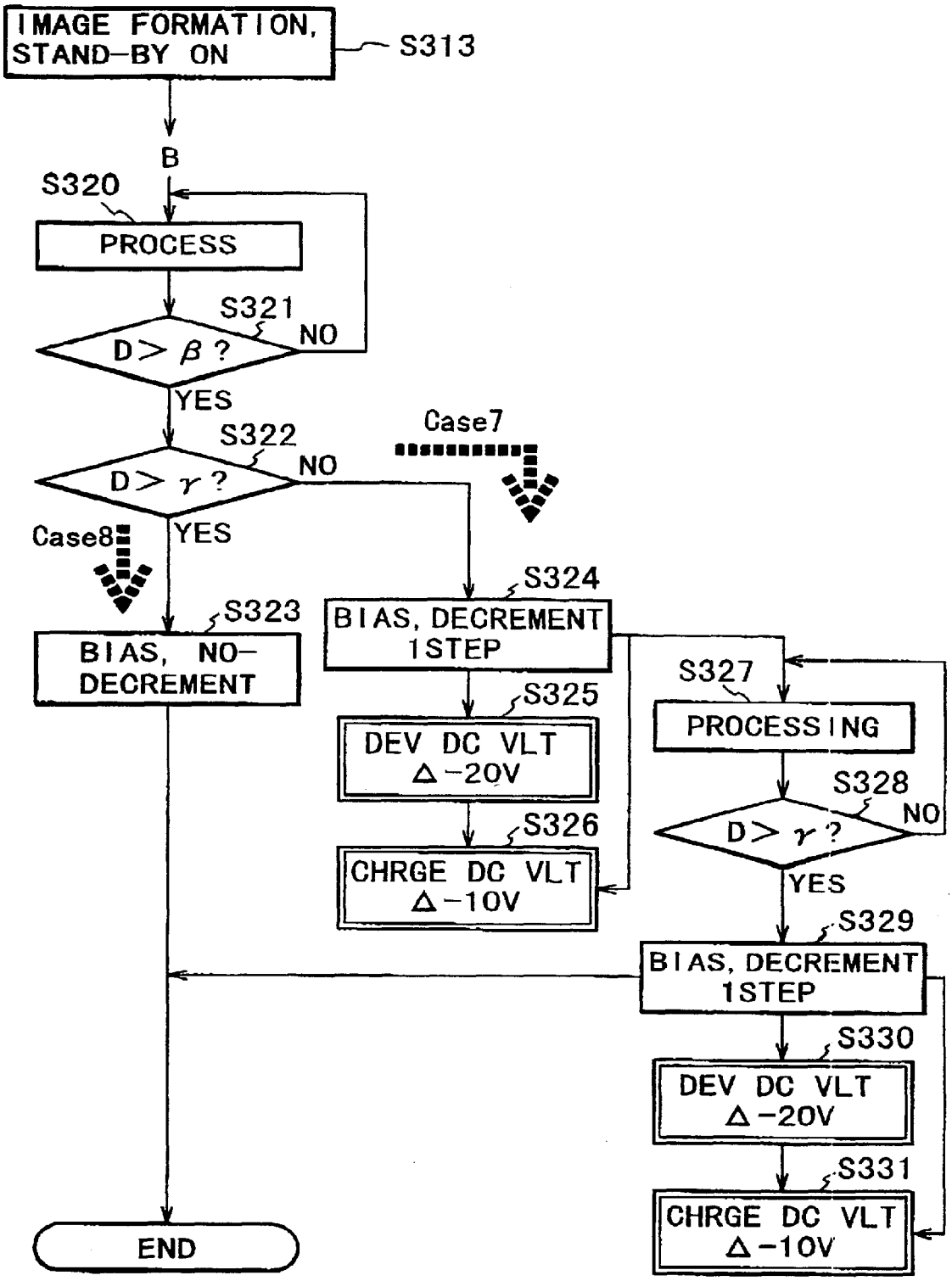
FIG. 18 is a flow chart for the image forming operation in the second embodiment of the present invention.

Next, referring to the flow charts in FIGS. 16, 17 and 18, the operation of the image forming apparatus in this embodiment will be described.

(1) A sequence from the step of turning ON the power source on the main assembly to the computation step prior to the step of the image formation standby ON will be described. This sequence is also to be carried out immediately after process-cartridge installation.

The operation of the image forming apparatus is started (START). Each of the following steps S301–S313 is carried out:

S301: the power source of the image forming apparatus main assembly is turned on;

S302: the photosensitive member rotation time detecting section 67 and the charge bias application time detecting portion 68 each begin to count the length of the photosensitive member rotation time and the length of the charge bias application time, respectively;

S303; the control portion 65 confirms the drum sensitivity information in the memory 62;

S304: the control portion 65 confirms whether or not the drum sensitivity information is "M";

(1-1) Case 1: if "M"="YES", in S304:

S305: the control portion 65 selects "bias 1" and sends signals for varying development and charge biases to a development bias application power source control portion (unillustrated) and a charge bias application power source control portion (unillustrated), respectively;

S306: the development DC bias power source is set to −450 V;

S307: the charge DC bias power source is set to −600 V;

S308: the control portion 65 confirms the photosensitive member rotation time and charge bias application time;

S309: computation is carried out in memory 62, and in the control section 64 on the main assembly side;

(1-2) Case 2: if "M"="NO", in S304:

S310: the control portion 65 confirms whether or not the drum sensitivity information is "L";

S311: if it is "YES", the control portion 65 selects "bias 2", and sends signals for varying development and charge biases to a development bias application power source control portion (unillustrated) and a charge bias application power source control portion (unillustrated), respectively;

S312: the development DC bias power source is set to −470 V;

S313: the charge DC bias power source is set to −610 V;

S308: the control portion 65 confirms the photosensitive member rotation time and charge bias application time;

S309: computation is carried out in memory 62, and in the control section 64 on the main assembly side;

(1-3) Case 3: if "L"="NO", in S310:

S314: the control portion 65 confirms whether or not the drum sensitivity information is "H";

S315: if it is "YES", the control portion 65 selects "bias 3", and sends signals for varying development and charge biases to a development bias application power source control portion (unillustrated) and a charge bias application power source control portion (unillustrated), respectively, whereas if it is "NO", the operation returns to S303 to reconfirm the drum sensitivity information;

S316; the development DC bias power source is set to −430 V;.

S317: the charge DC bias power source is set to −590 V;

S308: the control portion 65 confirms the photosensitive member rotation time and charge bias application time;

S309: computation is carried out in memory 62, and in the control section 64 on the main assembly side.

(2) Sequence from the computation step prior to the step of image formation standby ON to the step of image formation standby ON:

(2-1) Case 4: if the condition: $D>\beta$ is "YES", in S310:

S311: the control portion 65 confirms whether or not the condition: $D>\gamma$ is satisfied, and if the answer is "YES", the operation advances to S312;

S312: the control portion 65 selects "bias 0 STEP UP";

S313: the control portion 65 selects "image formation standby ON".

(2-2) Case 5: if the condition: $D>\gamma$ is "NO", in S311:

S314: the control portion 65 selects "bias 1 STEP UP", and sands signals for varying development and charge biases to a development bias application power source control portion (unillustrated) and a charge bias application power source control portion (unillustrated), respectively;

S315: the development DC bias power source raises the voltage by −20 V;

S316: the charge DC bias power source raises the voltage by −10 V;

S313: the control portion 65 selects "the image formation standby ON".

(2-3) Case 6: if the condition: $D>\beta$ is "NO", in S310:

S317: the control portion 65 selects "bias 2 STEP UP", and sends signals for varying development and charge biases to a development bias application power source control portion (unillustrated) and a charge bias application power control portion (unillustrated), respectively;

S318: the development DC bias power source raises the voltage by −40 V;

S319: the charge DC bias power source raises the voltage by −20 V;

S313: the control portion 65 selects "image formation standby ON".

(3) Sequence from the step of image formation standby ON to the completion of the process condition change:

S313: the control portion 65 selects "image formation standby ON";

S320: computation is carried out in the memory 62, and in the control section 64 of the main assembly;

S321: the control portion 65 determines whether or not the computed drum usage data is larger than the threshold value β stored in the memory. If the answer is "YES", the operation advances to S322, whereas if the answer is "NO", the operation returns to S320, and the above described sequence is repeated;

S322: the control portion 65 determines whether or not the drum usage data is greater than the threshold value γ stored in the memory;

(3-1) Case 7: if the answer in S322 is "YES";

S323: the control portion 65 selects "bias 0 STEP DOWN".

This conducts the control operation (END).

(3-2) Case 8: if the answer in S322 in "NO":

S324: the control portion 65 selects "bias 1 STEP DOWN", and sends signals for varying development and charge biases to a development bias application power source control portion (unillustrated) and a charge bias application power source control portion (unillustrated), respectively;

S325: the development DC bias power source lowers the voltage by −20 V;

S326: the charge DC bias power source lowers voltages by −10 V;

S327: computation is carried out in memory 62, and in the control section 64 of the main assembly;

S328: the control portion 65 determines whether or not the computed drum usage data is larger than the threshold value γ stored in the memory. If the answer is "YES", the operation advances to S329, whereas if the answer is "NO", the operation returns to S327, and the above described sequence is repeated;

S329: the control portion 65 selects "bias 1 STEP DOWN", and sends signals for varying development and charge biases to a development bias application power source control portion (unillustrated) and a charge bias application power source control portion (unillustrated), respectively;

S330: the development DC bias power source lowers the voltage by −20 V;

S331: the charge DC bias power source lowers the voltage by −10 V;

This concludes the control operation (END).

Referring to FIG. 12, the change in the line width which occurred as the result of control such as the one described above is represented by the single dot chain line.

As is evident from FIG. 12, the changes in line width remained within an acceptable range of 180–190 μm, assuring image stability.

As described above, the charge and development DC biases applied in the initial period of an image forming operation are adjusted for each cartridge, according to the drum sensitivity information and drum usage data, prior to the image formation standby step. Thereafter, the biases are varied to proper levels in accordance with the characteristic value of each cartridge, during the operation, so that the line width remains stable.

Although two thresholds values were provided pertaining to the drum usage data, in this embodiment, three or more threshold values may be provided in consideration of the characteristics of the initial condition and structure of a cartridge. Further, in this embodiment, the biases are lowered by a single unit of change during each control subsequence. However, it may be lowered by a plurality of units per control sub-sequence.

Further, in this embodiment, charge and development voltages are varied in potential level to control the image formation process. However, they may be varied in frequency. Further, the amount of exposure may be varied. Further, in this embodiment, the value computed with the use of the above described equation is used as the usage data. However, the value of print count or cumulative length of photosensitive member rotation time alone may be used as the usage data.

Embodiment 3

Next, the third embodiment of the present invention will be described. The structures of the image forming apparatus and process cartridge in this third embodiment are the same as those in the first and second embodiments. Therefore, their description will be omitted, and only their distinctive features will be described.

In the second embodiment, the amount of the charge and development DC voltage were varied on the basis of the drum usage amount as the usage data in the memory, and three characteristic values: the threshold value for the usage data, the coefficient, and the drum sensitivity information. However, in this embodiment, the drum usage amount threshold value record is used in addition to the above described information, which characterizes this embodiment. With the addition of the drum usage amount threshold value record, computation becomes unnecessary even prior to the step of "image formation standby ON", reducing the time before the first print can be produced.

The three characteristic values: the threshold value for the usage, the coefficient, and the drum sensitivity information, are the same as those in the second embodiment, and therefore, their descriptions will be omitted here.

Figure 19:
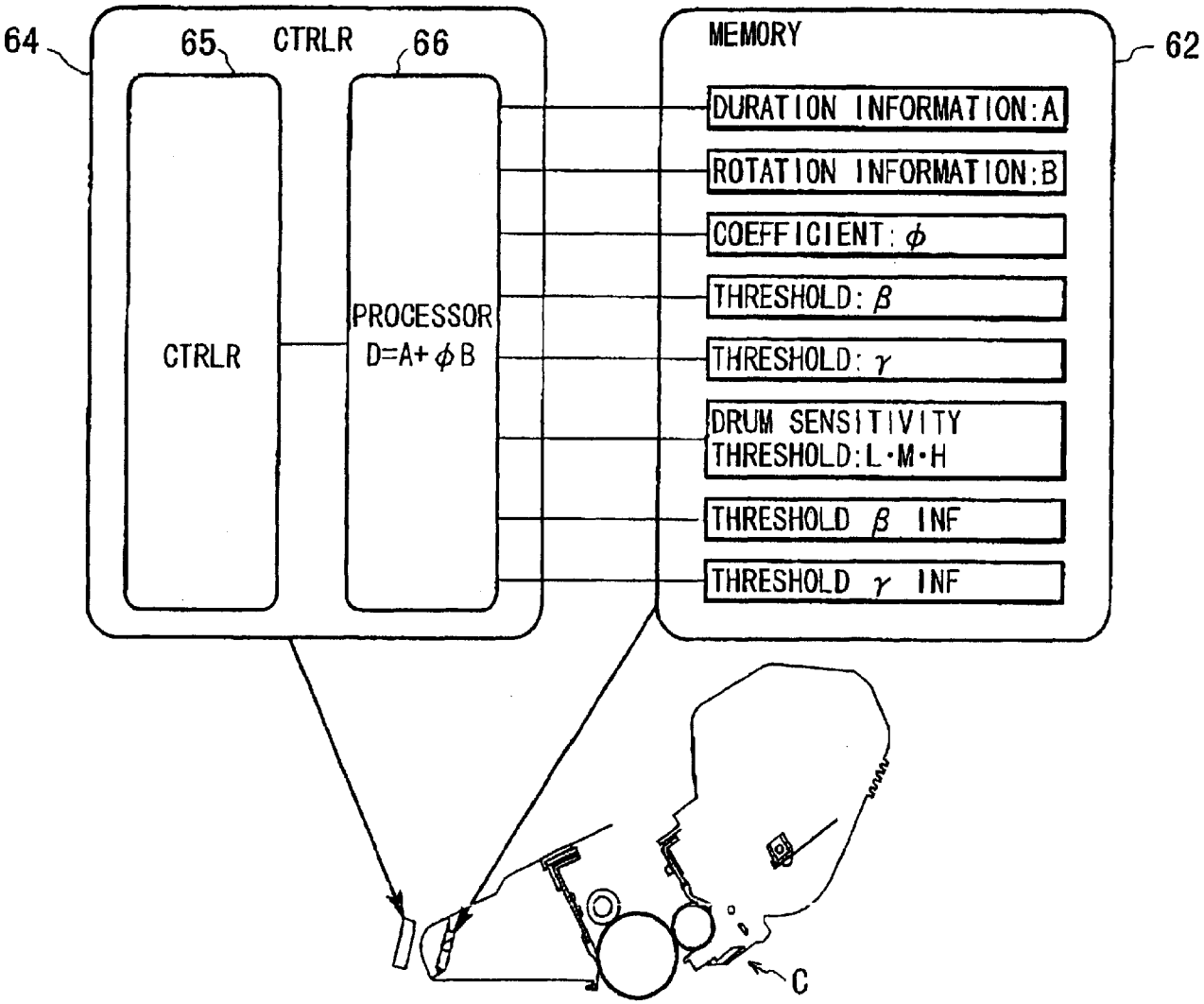
FIG. 19 is a block diagram which shows the relationship between the control section on the main assembly side and the information within the memory, in the third embodiment of the present invention.

FIG. 19 shows the information within the memory 62. Although there are various types of information stored in the memory 62, at least the following types of information are stored: information A or the length of time the charge bias was applied; information B or the length of time the photosensitive member was rotated; coefficient ø for the equation for computing the length of drum usage; β, γ or the threshold values for the equation for computing the length of drum usage; L.M.H or drum sensitivity threshold values; and drum usage amount record β; and drum usage amount record γ. These types of information in the memory 62 are rendered always transmittable between the memory 62 and the control section of the main assembly. The computation is carried out based on these types of information, and the results of the computation are compared to the stored data by the control portion 65.

Figure 21:
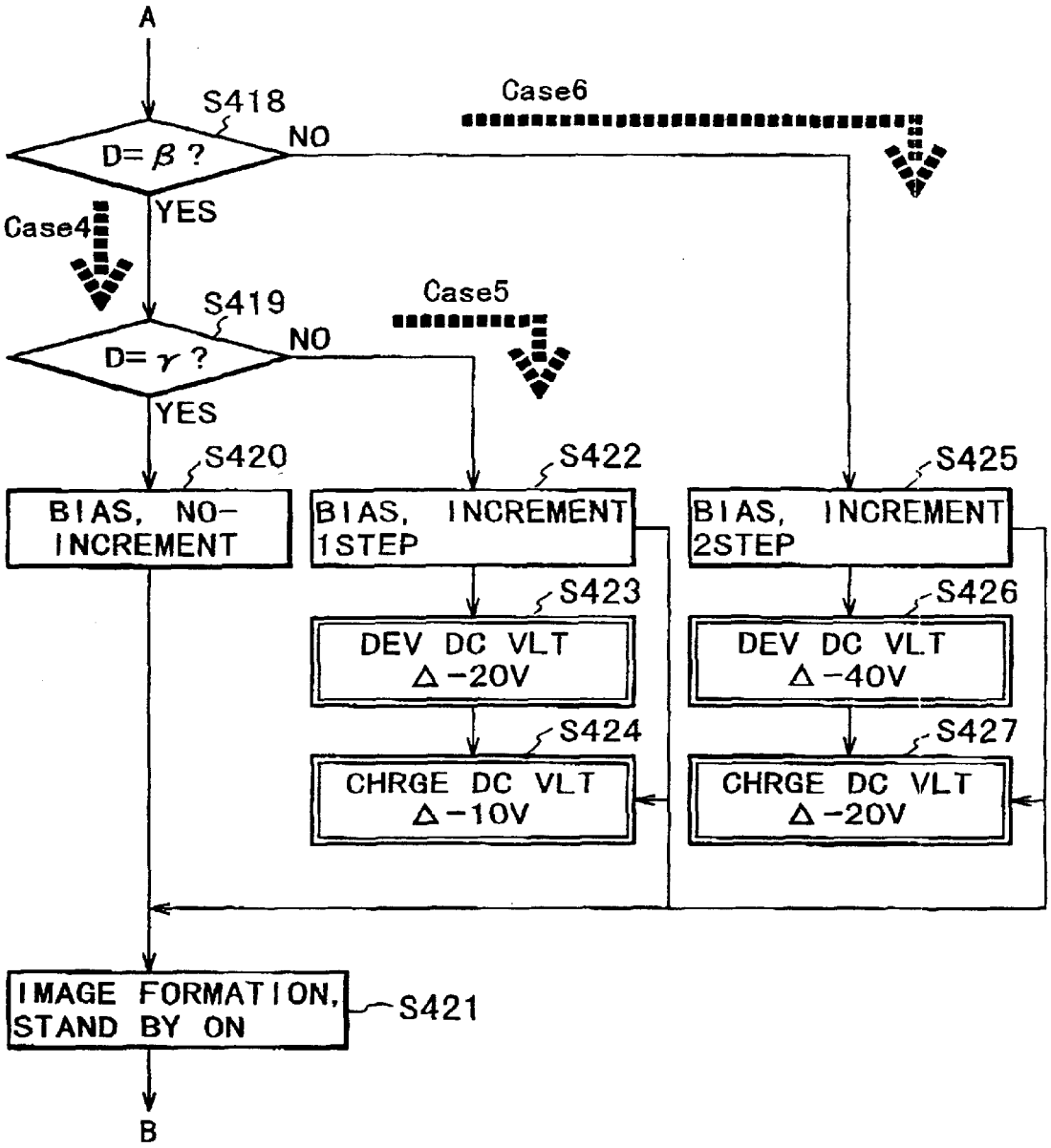
FIG. 21 is a flow chart for the image forming operation in the third embodiment of the present invention.
Figure 22:
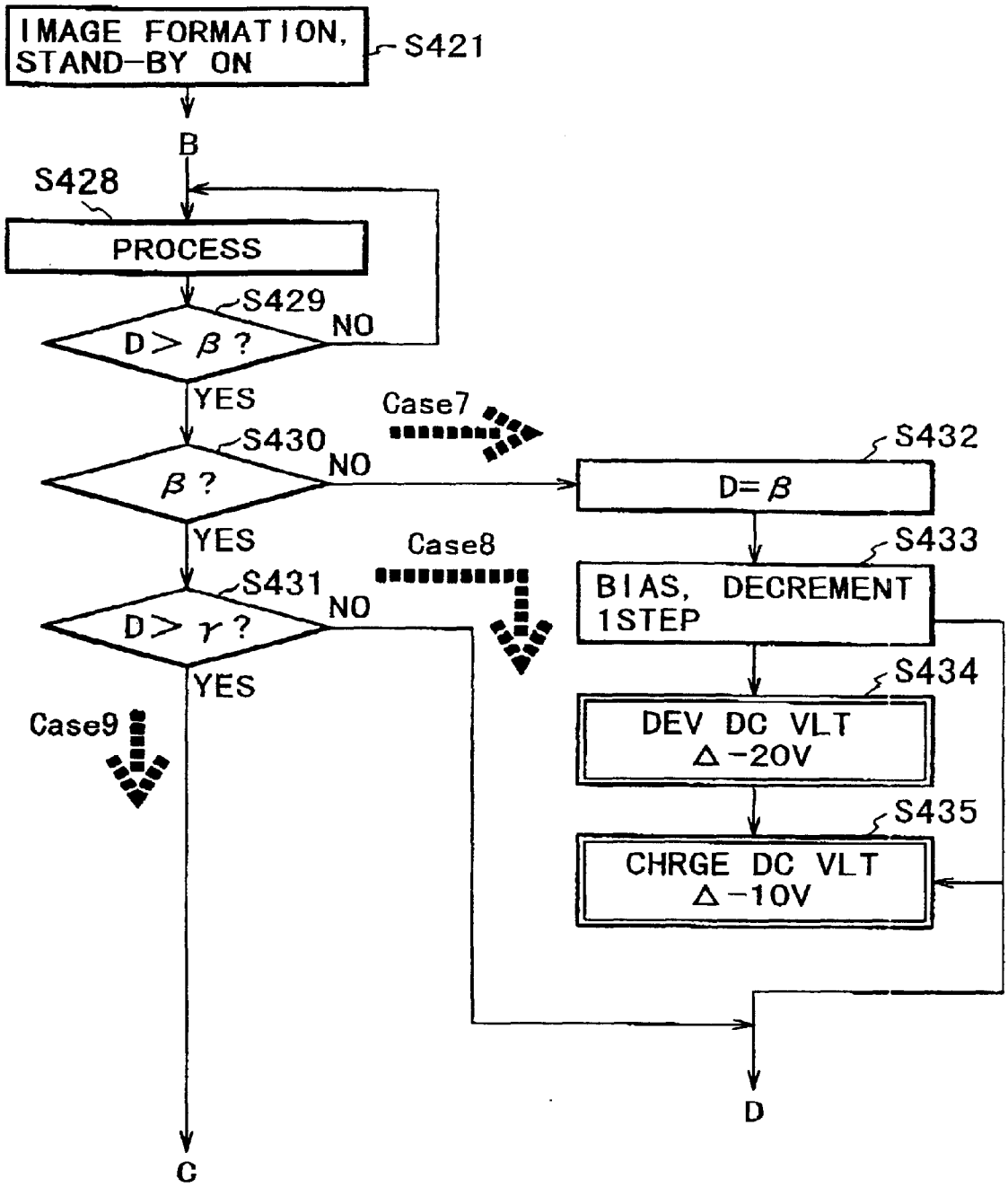
FIG. 22 is a flow chart for the image forming operation in the third embodiment of the present invention.
Figure 23:
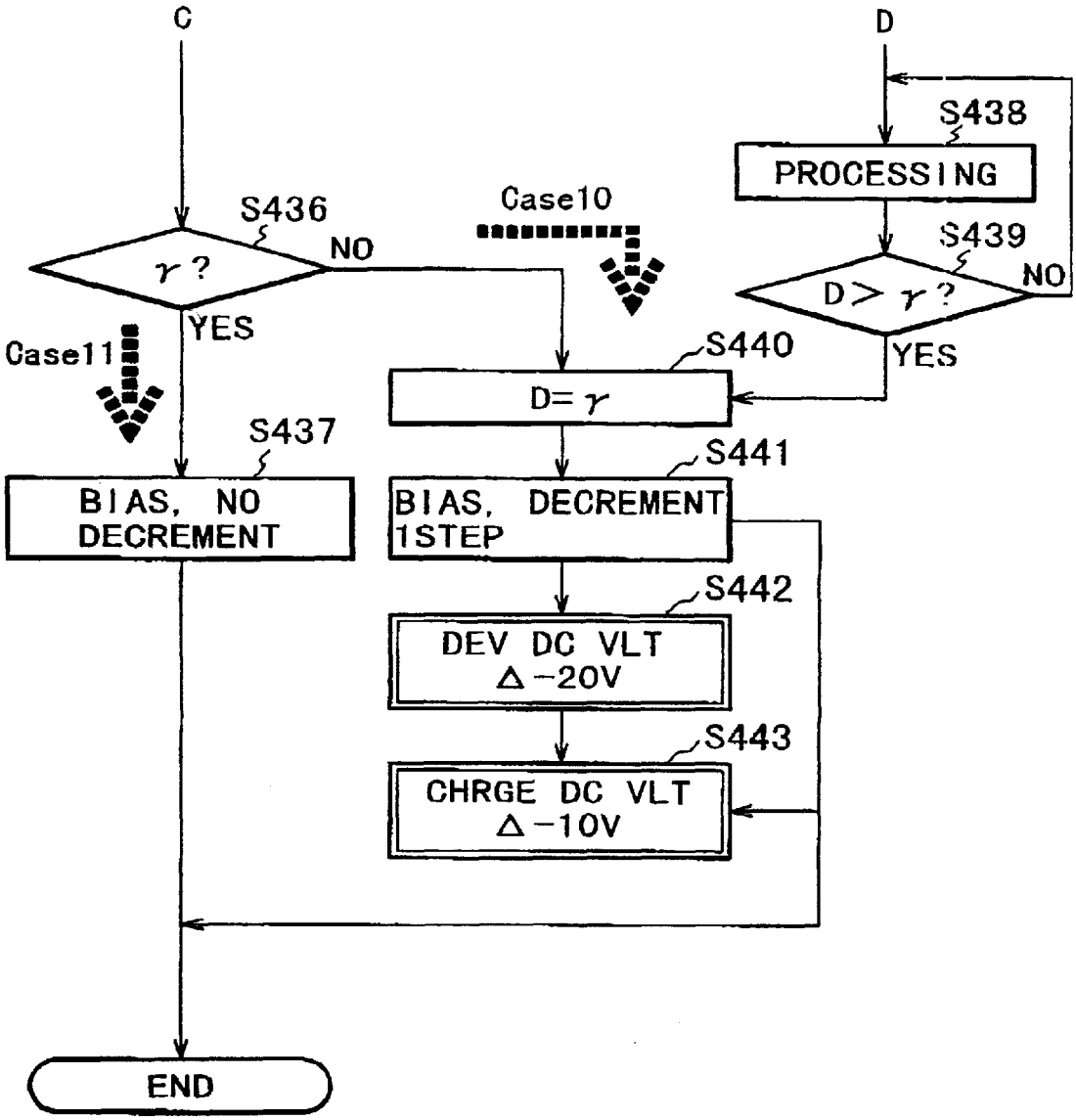
FIG. 23 is a flow chart for the image forming operation in the third embodiment of the present invention.

Next, referring to the flow charts in FIGS. 21, 22 and 23, the operation of the image forming apparatus in this embodiment will be described.

(1) A sequence from the step turning ON the power source on the main assembly to the step of confirming record β, which is to be also carried out immediately after process cartridge installation:

The operation of the image forming apparatus is started (START), and each of the following steps S401–S437 is carried out:

S401: the power source of the image forming apparatus main assembly is turned ON;

S402: the photosensitive member rotation time detecting section and the charge bias application time detecting portion each begin to count the length of the photosensitive member rotation time and the length of the charge bias application time, respectively;

S403: the control portion 65 confirms the drum sensitivity information in the memory 62;

S404: the control portion 65 confirms whether or not the drum sensitivity information is "M";

(1-1) Case 1: if "M"="YES", in S404:

S405; the control portion 65 selects "bias 1" and sends signals for varying development and charge biases to a development bias application power source control portion (unillustrated) and a charge bias application power source control portion (unillustrated), respectively;

S406; the development DC bias power source is set to −450 V;

S407: the charge DC bias power source is set to −600 V;

(1-2) Case 2: If "M"="NO", in S404:

S410: the control portion 65 confirms whether or not the drum sensitivity information is "L";

S411: if it is "YES", the control portion 65 selects "bias 2", and sends signals for varying development and charge biases to a development bias application power source control portion (unillustrated) and a charge bias application power source control portion (unillustrated), respectively;

S412: the development DC bias power source is set to −470 V;

S413: the charge DC bias power source is set to −610 V;

(1-3) Case 3: if "L"="NO", in S410:

S414: the control portion 65 confirms whether or not the drum sensitivity information is "H";

S415: if it is "YES", the control portion 65 selects "bias 3", and sends signals for varying development and charge biases to a development bias application power source control portion (unillustrated) and a charge bias application power source control portion (unillustrated), respectively, whereas it it is "NO", the operation returns to S403 to reconfirm the drum sensitivity information;

S416: the development DC bias power source is set to −430 V;

S417: the charge DC bias power source is set to −590 V;

(2) Sequence from the confirmation of the record β to the step of image formation standby ON:

S418: it is confirmed whether or not there is a record of "D=β";

(2-1) Case 4: if the answer in S418 is "YES";

S419: it is confirmed by the control portion 65 whether or not there is a record of "D=γ", and if the answer is "YES, the operation advances to S420;

S420: the control portion 65 selects "bias 0 STEP UP";

S421: the control portion 65 selects "image formation standby ON".

(2-2) Case 5: if the answer in S419 is "NO":

S422: the control portion 65 selects "bias 1 STEP UP", and sends signals for varying development and charge biases to a development bias application power source control portion (unillustrated) and a charge bias application power source control portion (unillustrated), respectively;

S423: the development DC bias power source raises the voltage by −20 V;

S424: the charge DC bias power source raises the voltage by −10 V;

S421: the control portion 65 selects "the image formation standby ON".

(2-3) Case 6: if the answer in S418 is "NO":

S425; the control portion 65 selects "bias 2 STEP UP", and sends signals for varying development and charge biases to a development bias application power source control portion (unillustrated) and a charge bias application power source control portion (unillustrated), respectively;

S426: the development DC bias power source raises the voltage by −40 V;

S427: the charge DC bias power source raises the voltage by −20 V;

S421; the control portion 65 selects "image formation standby ON".

(3) Sequence from the step of image formation standby ON to the completion of the process condition change:

S421: the control portion 65 selects "image formation standby ON";

S428: computation is carried out in the memory 62, and in the control section 64 of the main assembly;

S429: the control portion 65 determines whether or not the computed drum usage data is larger than the threshold value β stored in the memory. If the answer is "YES", the operation advances to S430, whereas if the answer is "NO", the operation returns to S428, and the above described sequence is repeated;

S430: the control portion 65 determines whether or not there is a record β;

(3-1) Case 7: if the answer in S430 is "NO";

S432: the control portion 65 records "D=β" in the memory 62:

S433: the control portion 65 selects "bias 1 STEP DOWN", and sends signals for varying development and charge biases to a development bias application power source control portion (unillustrated) and a charge bias application power source control portion (unillustrated), respectively;

S434: the development DC bias power source lowers the voltage by −20 V;

S435: the charge DC bias power source lowers the voltage by −10 V;

S438: computation is carried out in memory 62, and in the control section 64 of the main assembly;

S439: the control portion 65 determines whether or not the computed drum usage data is larger than the threshold value γ stored in the memory. If the answer is "YES", the operation advances to S440, whereas if the answer is "NO", the operation returns to S438, and the above described sequence is repeated;

S440: "D=γ" is recorded in the memory;

S441: the control portion 65 selects "bias 1 STEP DOWN", and sends signals for varying development and charge biases to a development bias application power source control portion (unillustrated) and a charge bias application power source control portion (unillustrated), respectively;

S442: the development DC bias power source lowers the voltage by −20 V;

S443: the charge DC bias power source lowers the voltage by −10 V;

This concludes the control operation (END).

(3-2) If the answer is S430 is "YES":

S431: the control portion 65 determines whether or not the computed drum usage data is larger than the threshold value γ stored in the memory. If the answer is "YES", the operation advances of S436, whereas if the answer is "NO", the operation advances to S438;

(3-2-1) Case 8: if the answer in S431 is "NO":

S438: if the answer in S431 is "NO", the computation is carried out in the memory 62, and in the control section 64 of the main assembly;

S439: the control portion 65 determines whether or not the computed drum usage data is larger than the threshold value γ stored in the memory. If the answer is "YES", the operation advances to S440, whereas if the answer is "NO", the operation returns to S438, and the above sequence is repeated;

S440: "D=γ" is recorded in the memory 62;

S441: the control portion 65 selects "bias 1 STEP DOWN", and sends signals for varying development and charge biases to a development bias application power source control portion (unillustrated) and a charge bias application power source control portion (unillustrated), respectively;

S442: the development DC bias power source lowers the voltage by −20 V;

S443: the charge DC bias power source lowers the voltage by −10 V;

This concludes the control operation (END).

(3-2-2) Case 9: if the answer in S431 is "YES":

S436; the control portion 65 confirms whether or not there is a record β;

S437: if the answer in S436 is "YES", the control portion 65 selects "bias 0 STEP DOWN";

This concludes the control operation (END).

(3-2-3) Case 10: if the answer in S436 is "NO":

S440: "D=γ" is recorded in the memory 62;

S441: the control portion 65 selects "bias 1 STEP DOWN", and sends signals for varying development and charge biases to a development bias application power source control portion (unillustrated) and a charge bias application power source control portion (unillustrated), respectively;

S442: the development DC bias power source lowers the voltage by −20 V;

S443: the charge DC bias power source lowers the voltage by −10 V;

This concludes the control operation (END).

As described above, with the provision of the drum usage amount record (usage history), the computation is unnecessary even prior to the step of "image formation standby ON", reducing the time before the first print can be produced while providing the same effects as those in the second embodiment.

In this embodiment, two threshold values are provided pertaining to the drum usage data as in the second embodiment. However, three or more threshold values may be provided on the basis of the characteristics of a cartridge, for example, the initial condition of each cartridge, and cartridge structure. Further, bias was lowered by a single unit of variation per sub-sequence. However, it may be raised or lowered by a plurality of units of variation. Further, charge and development voltages were varied in potential level to adjust the processing condition. However, according to circumstances, charge and development voltages may be varied in frequency, or the amount of exposure may be varied.

Embodiment 4

Next, the fourth embodiment of the present invention will be described.

In this embodiment:

(1) Cumulative length of the cartridge usage is computed from the length of the time the process cartridge C is driven in the image forming apparatus main assembly 100, using an equation, and this cumulative length of the cartridge usage will be referred to as "drum usage amount".

(2) The process cartridge C is provided with a memory 22, in which the aforementioned threshold value pertaining to the usage amount determined by the combined characteristics of the photosensitive drum 1 and charge roller 2 in each cartridge, and a coefficient pertaining to the aforementioned equation determined by the characteristics of the photosensitive drum 1, are stored.

(3) The cartridge usage amount is computed based on the length of the time the cartridge has been driven, which is measured by the image forming apparatus main assembly 100 and stored in the memory 22, and the coefficient stored in the memory 22, and the cumulative length of the cartridge usage is stored in the memory 13 on the main assembly side. The electrical current applied to the charge roller 2 is varied as the aforementioned value of the cumulative cartridge usage amount matches the threshold value stored in the memory 22.

Incidentally, the number of the threshold values stored in the memory 22 of the cartridge C may be plural, and the value of the charge current may be switched twice or more. With the above described control, it is possible to satisfactorily charge the photosensitive drum 1 while keeping the charge current value as small as possible, and therefore, the service life of the photosensitive drum 1 is extended.

Next, referring to FIGS. 24 and 25, the overall structure of the image formation system in this embodiment will be described.

Figure 24:
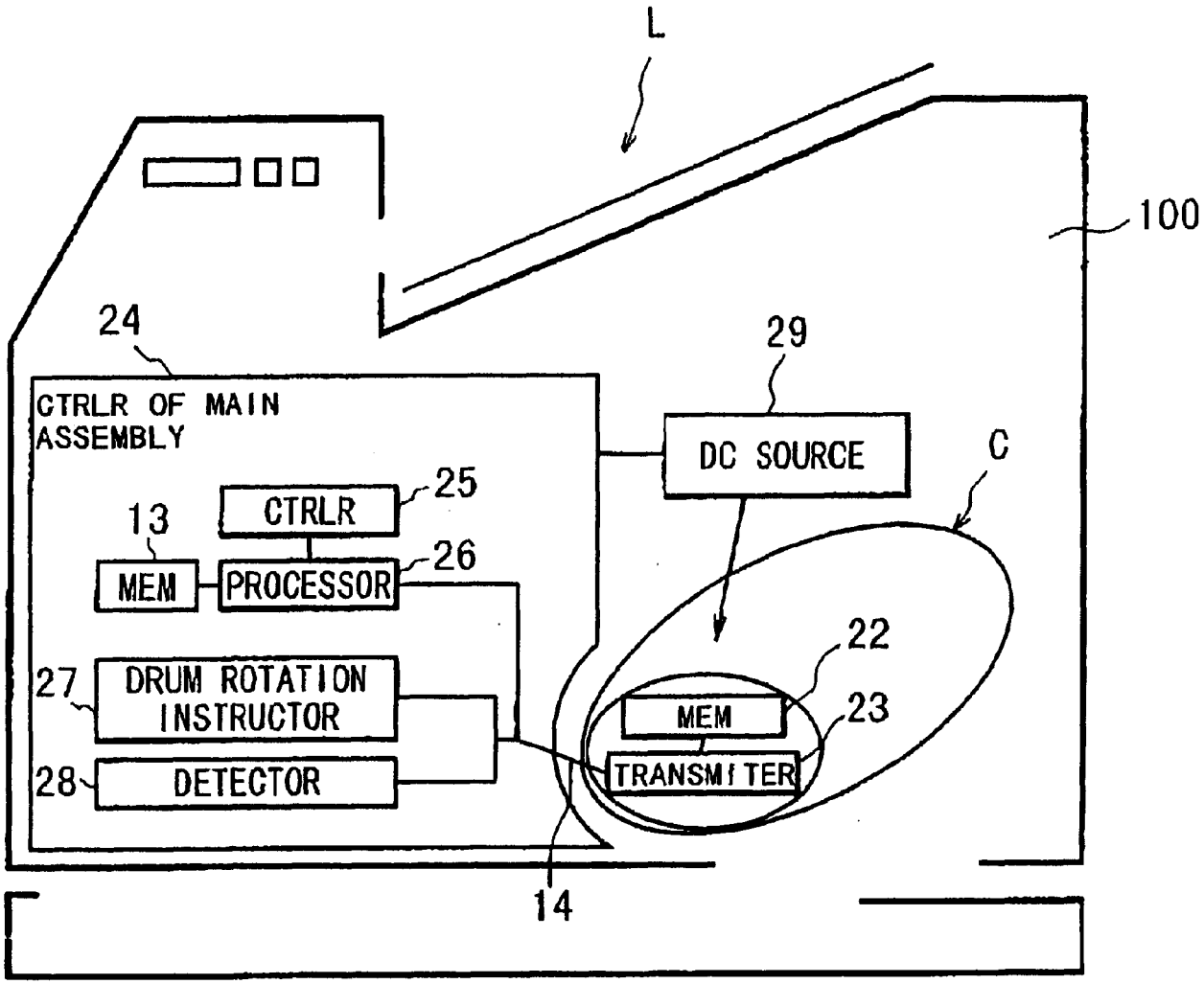
FIG. 24 is a block diagram which shows the control section on the main assembly side, and the information in the memory, in the fourth embodiment of the present invention.

As shown in FIG. 24, the control section 24 on the main assembly side has a data storage memory 13, a control portion 25, a computing portion 26, a photosensitive member rotation control portion 27, a charge bias application time detecting portion 28, a communicating portion 14, and the like. The cartridge C has a memory 22 and a communicating portion 23.

Figure 25:
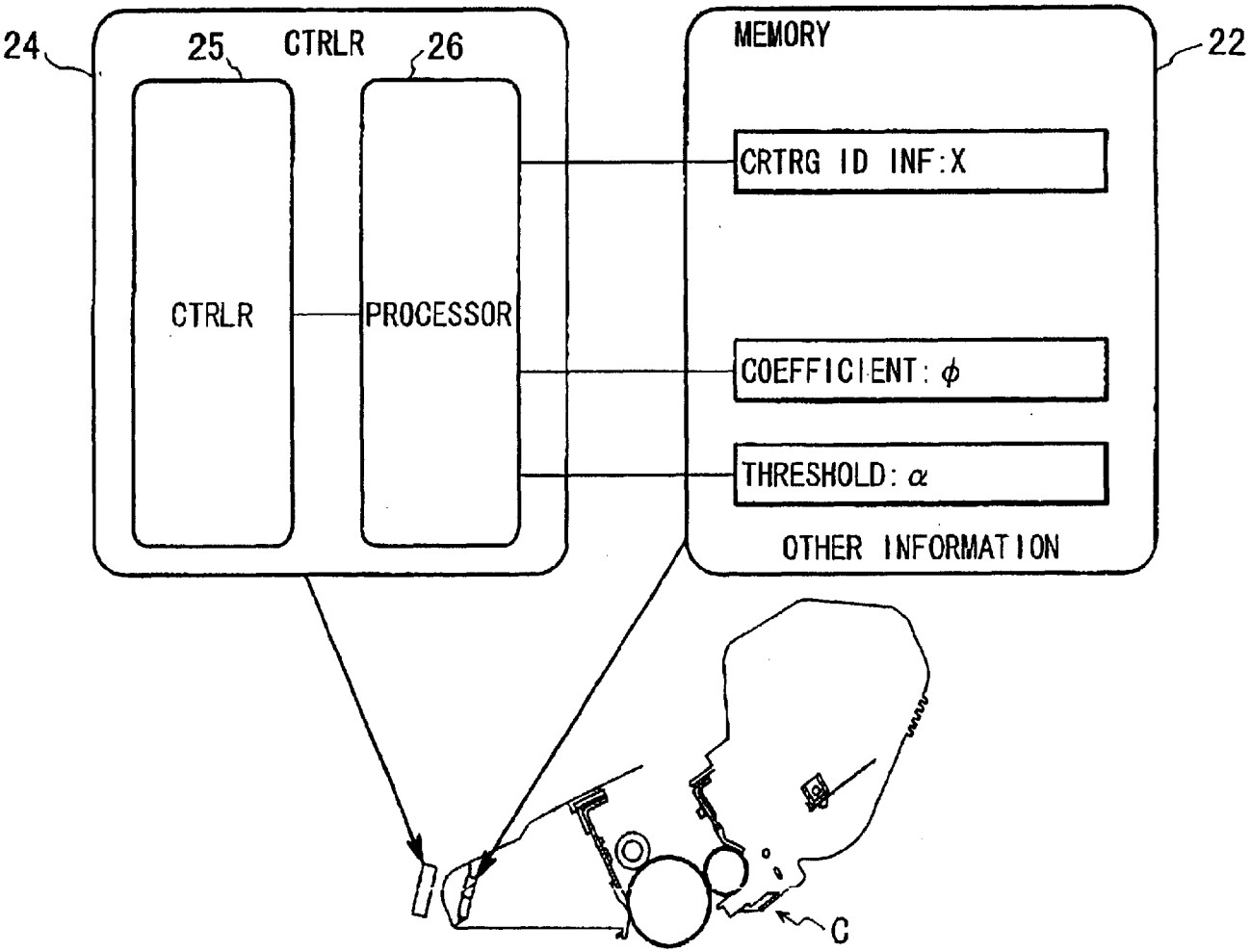
FIG. 25 is a block diagram which shows the relationship between the control portion on the main assembly side and the information in the memory in the fourth embodiment of the present invention.

Referring to FIG. 25, a coefficient ϕ pertaining to the drum usage computation equation, a threshold value α pertaining to drum usage amount, and information X pertaining to cartridge characteristics (hereinafter, "ID information"), are stored in the memory 22 of the cartridge C. The ID information is information for the image forming apparatus main assembly 100 to detect whether or not the cartridge C has been replaced. In other words, it may be any type of information as long as it provides the identity of each cartridge. More specifically, it is a serial number of the cartridge C or the like.

The threshold value α and coefficient ϕ are stored in the memory 22 at the time of shipment. These values vary depending upon the sensitivity and material of the photosensitive drum, and the surface condition of the charge roller 2, and the like.

Next, the control operation in this embodiment will be described.

As the Image forming apparatus main assembly 100 receives a print signal, the driving of the cartridge C is started by the photosensitive member rotation control portion 27, to start an image formation process. At this point in operation, the drum usage amount is computed.

The drum usage data D is computed by the computing portion 26 using the information B or the cumulative length of time the photosensitive member was rotated, which is obtained from the photosensitive member rotation control portion 27, the information A or the cumulative length of time the charge bias was applied, which is obtained from the charge bias application time detecting portion 28, and a conversion equation weighted by the coefficient $\phi$ read out of the memory 22: $D=A+(B\times\phi)$. The results are cumulatively stored in the memory 13 within the apparatus main assembly 100.

The value of the cumulative stored drum usage amount is compared with the threshold value $\alpha$ in the memory 22 of the cartridge C.

If the value of the drum usage amount D is greater than the value of $\alpha$, a control signal is sent to the charge bias power source 29 from the control portion 25 to change the charge bias.

As long as the ID information X remains unaltered, the drum usage amount D continues to be cumulatively stored. When it is recognized that the ID information X has been altered, it is assumed that the cartridge has been replaced, and the value of the drum usage amount D is reset.

The data regarding the length of the photosensitive member rotation time, and the data regarding the length of the charge bias application time, are to be continuously stored in the memory, and the drum usage data are to be computed whenever the driving of the photosensitive drum 1 is stopped.

Figure 26:
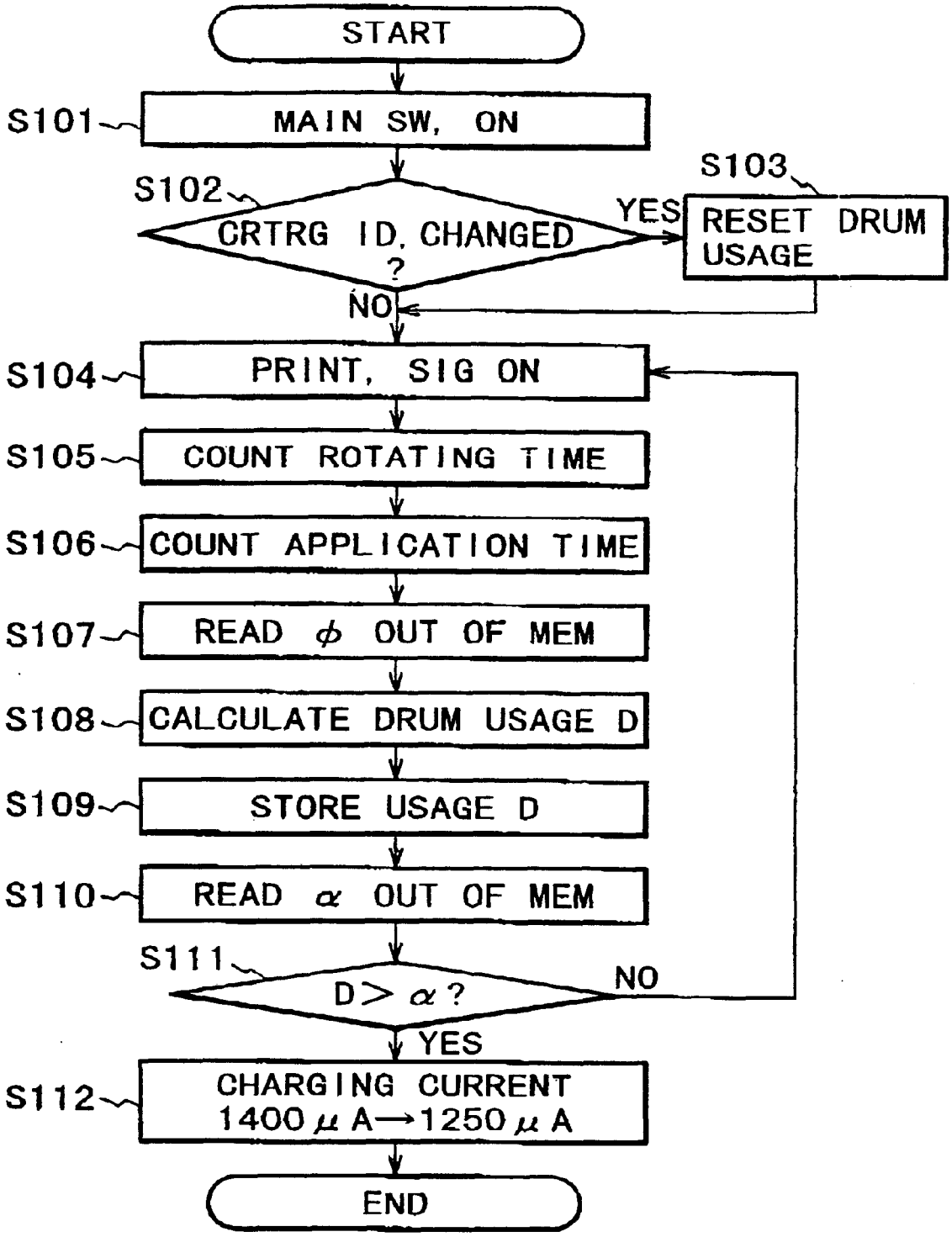
FIG. 26 is a flow chart for the image forming operation in the fourth embodiment of the present invention.

Next, referring to the flow chart in FIG. 26, the operation of the image forming apparatus in this embodiment will be described.

The operation of the image forming apparatus is started (START), and each of the following steps S101–S112 is carried out:

S101: the power source of the image forming apparatus main assembly is turned on;

S102: the cartridge ID information is checked to confirm whether or not the cartridge has been replaced:

S103: if the ID has been changed, the value of the drum usage data is set to zero;

S104: a print signal is turned on;

S105: the photosensitive member rotation time detecting section 27 begins to count the length of the photosensitive member rotation time;

S106: the charge bias application time detecting portion 28 begins to count the length of the charge bias application time;

S107: the coefficient $\phi$ is read out of the memory 22 of the cartridge C;

S108: the drum usage amount D is computed in the computing portion 26;

S109: the drum usage amount D is stored in the memory 13 of the apparatus main assembly 100;

S110: the threshold value $\alpha$ is read out by the control portion 25;

S111: the control portion 25 compares the drum usage data D with the threshold value $\alpha$; if the answer is "YES", the operation advances of S112, whereas if the answer is "NO", the operation returns to S104 to repeat the same sequence;

S112: a switching signal is transmitted from the control portion 25 to the charge bias power source 29 illustrated in FIG. 24, to change the charge current value. In this embodiment, as the threshold value $\alpha$ is reached, the charge current value, which is 1400 $\mu$A, is switched to 1250 $\mu$A.

This concludes the control operation (END).

When the current value was controlled as shown by the above described flow chart, and the solid line in FIG. 8, as in the first embodiment, the length of the service life of the photosensitive drum 1, which used to be 13000 in terms of print count, could be extended to 17000. In other words, according to the present invention, it is possible to satisfactorily charge the photosensitive drum 1 for maintaining image quality, while using as small an amount of charge current as possible, and therefore, it is possible to extend the service life of the photosensitive drum 1.

Although current switching is done only once in this embodiment, it may done in a plurality of steps depending upon the characteristics of individual cartridges. Further, the current value may be raised or lowered depending upon the condition of each cartridge. Also, two or more threshold values may be used pertaining to the drum usage data, although only one is used in this embodiment.

Figure 27:
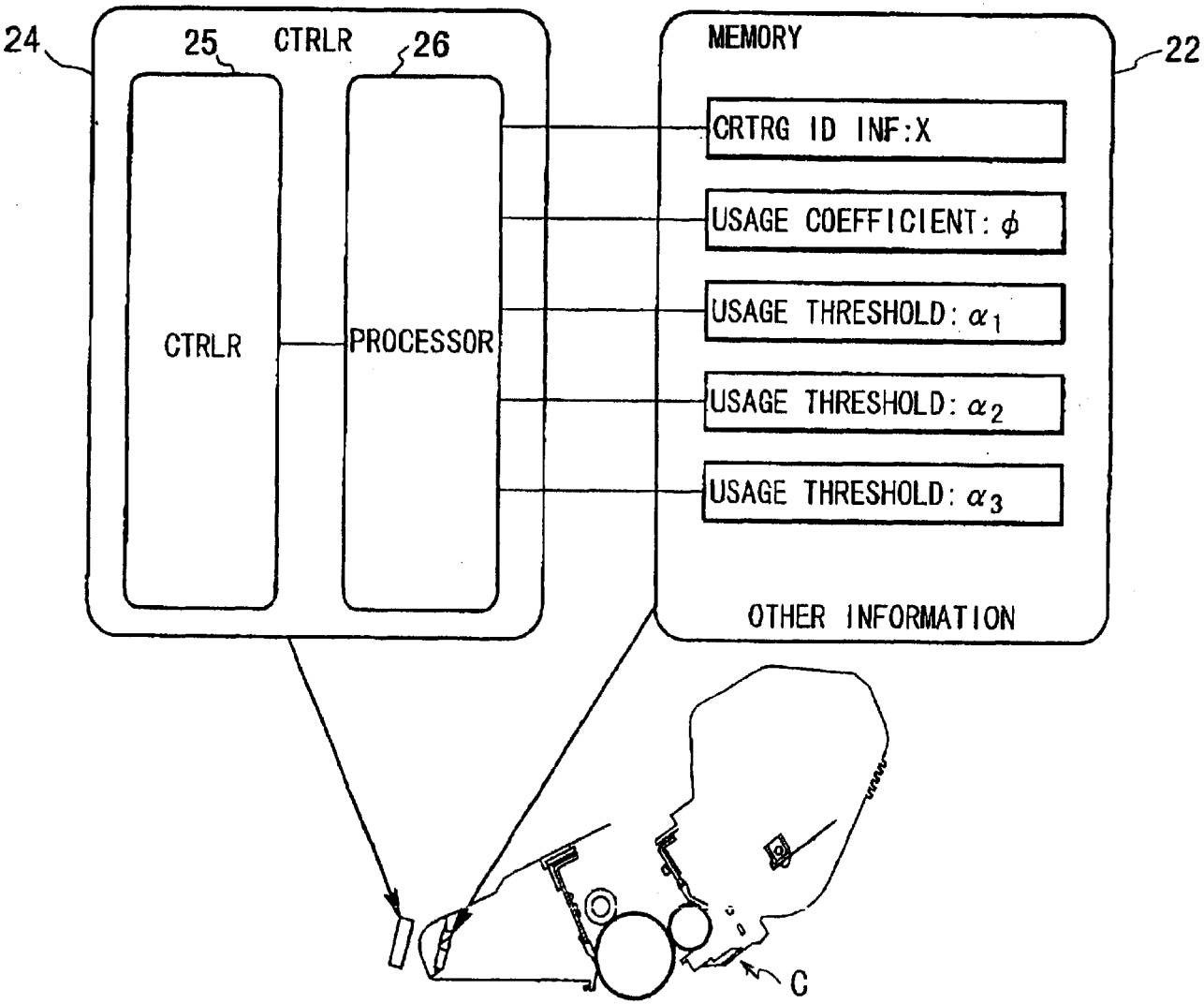
FIG. 27 is a block diagram which shows the relationship between the control portion on the main assembly side and the information in the memory, when there are a plurality of threshold values pertaining to the drum usage computing equation, in the fourth embodiment of the present invention.

FIG. 27 shows the information stored within the memory 22 when a plurality of threshold values pertaining to the drum usage data are used. In this embodiment, at least the following kinds of information are stored in the memory 22: the cartridge ID information X, the coefficient $\phi$ for the drum usage amount computing equation, three threshold values $\alpha 1$, $\alpha 2$, $\alpha 3$ pertaining to the drum usage amount, although there are various other kinds of information stored therein. These types of information are rendered continually transmittable between the memory 22 of the cartridge C and the computing portion 26 within the control section 24 on the main assembly side. The results of the computation carried out based on these types information are compared to the referential data by the control portion 25.

Figure 28:
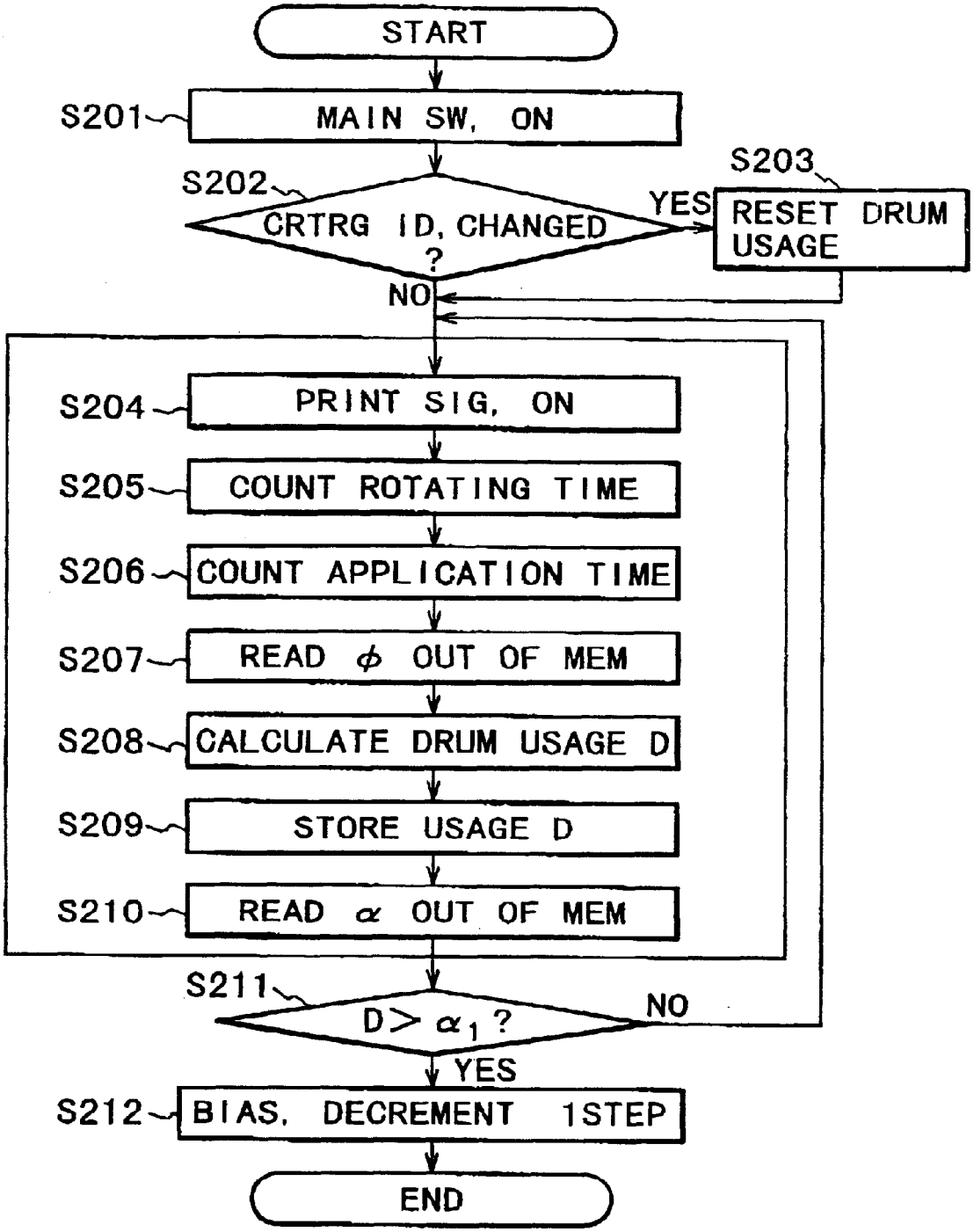
FIG. 28 is a flow chart for the image forming operation when there are plurality of threshold values pertaining to the drum usage amount computing equation, in the fourth embodiment of the present invention.
Figure 29:
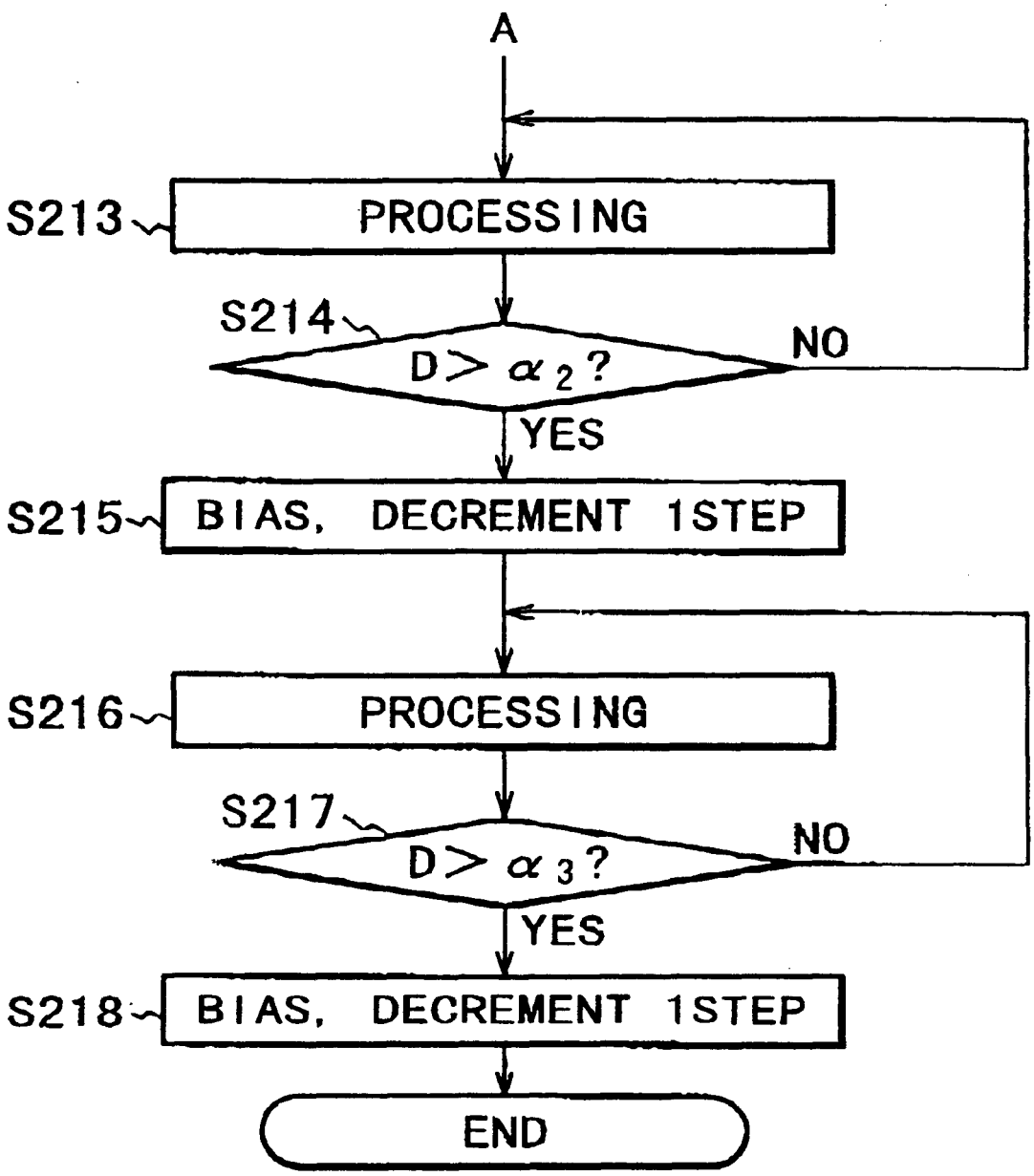
FIG. 29 is a flow chart for the image forming operation which there are plurality of threshold values pertaining to the drum usage amount computing operation, in the fourth embodiment of the present invention.

FIGS. 28 and 29 show the flow chart for switching the current value twice or more.

The operation of the image forming apparatus is started (START), and each of the following steps S201–S218 is carried out:

S201: the power source of the image forming apparatus main assembly is turned on;

S202: the cartridge ID Information is checked to confirm whether or not the cartridge has been replaced;

S203: if the ID has been changed, the value of the drum usage data is set to zero;

S204: a print signal is turned on;

S205: the photosensitive member rotation time detecting section 27 begins to count the length of the photosensitive member rotation time;

S206: the charge bias application time detecting portion 28 begins to count the length of the charge bias application time;

S207: the coefficient $\phi$ is read out of the memory 22 of the cartridge C;

S208: the drum usage amount D is computed in the computing portion 26;

S209: the drum usage amount D is stored in the memory 13 of the apparatus main assembly 100;

S210: the threshold value $\alpha$ is read out by the control portion 25;

S211: the control portion 25 compares the drum usage data D with the threshold value $\alpha 1$; if the answer is "YES", the operation advances of S212, whereas if the answer is "NO", the operation returns to S204;

S212: the selection of the bias level is lowered by one unit in the bias table stored in advance in the control portion 25, and a switching signal is transmitted from the control portion 25 to the charge bias power source 29 illustrated in FIG. 24, to change the charge current value. After the charge bias value change, the operation goes to A; in this embodiment, as the threshold value α is reached, the charge current value, which is 1400 μA, is switched to 1250 μA;

S213: computation is carried out in the memory 22, and in the control section 24 on the main assembly side;

S214: the control portion 25 determines whether or not the computed drum usage data reached the threshold value α2, stored in the memory 22. If the answer is "YES", the operation advances to S215, whereas if the answer is "NO", the operation returns to S213.

S215: the bias designation in the bias table stored in advance in the control portion 25 is lowered by one unit of change, and a switching signal is transmitted from the control portion 25 to the charge bias power source 29 illustrated in FIG. 24, to change the charge current value;

S216; computation is carried out in the memory 22, and in the control section 24 on the main assembly side;

S217: the control portion 25 determines whether or not the computed drum usage data reached the threshold value α3, stored in the memory 22. If the answer is "YES", the operation advances to S218, whereas if the answer is "NO", the operation returns to S216.

S218: the bias designation in the bias table stored in advance in the control portion 25 is lowered by one unit of change, and a switching signal is transmitted from the control portion 25 to the charge bias power source 29 illustrated in FIG. 24, to change the charge current value.

This concludes the control operation (END).

The above description was given pertaining to a case in which there were three threshold values at which the switching was to be made. However, there may be more than three threshold value at which the switching are to be made, as long as the switching is made within the scope of the present invention, which is obvious.

Embodiment 5

Next, the fifth embodiment of the present invention will be described. The structures of the image forming apparatus and process cartridge in this fifth embodiment are the same as those in the fourth embodiment. Therefore, their description will be omitted, and only their distinctive features will be described.

In the fourth embodiment, the amount of the charge current was varied based on the drum usage amount, as the usage data, in the memory 22, and two characteristic values, that is, the coefficient pertaining to the drum usage amount computing equation and the threshold value pertaining to the usage data. This embodiment is distinctive in that additional information, which pertains to the characteristics of the photosensitive drum 1, that is, the sensitivity of the photosensitive drum 1, is employed in addition to the data relied upon in the fourth embodiment, and the DC voltage applied to charge the photosensitive drum 1, and the DC voltage applied for developments are varied based on these data.

As described before, it has been known that there is a tendency that the line width in a print produced when a developing device is in an early stage or usage (when a relatively larger amount of toner is in the developing device) is less than the line width in a print produced when the developing device is in an advanced stage of usage. FIG. 12 shows the changes which occur to the actual width of a line in an image with a resolution of 600 dpi, the theoretical width of which corresponds to 4 dots, as a printing operation continues. Following the solid line in the graph reveals that the actual line width keeps on increasing during the initial period of the operation, that is, while printing the first 1000 copies.

Although various causes are conceivable for this phenomenon, it may be listed as the primary cause that the amount of the toner charge, and the potential level V1 of the photosensitive drum, are unstable in the initial period of the operation. In other words since the potential level VL is affected by the selection of a sheet feeding mode, and the resultant latent image is faithfully reproduced, the line tends to become narrower in the initial period in which fluctuation in potential level VL is greater. Further, there is a substantial amount of difference in the sensitivity of the drum, that is, the potential level VL, among the groups of process cartridge different in lot number.

Thus, in this embodiment:

(1) The length of the time a given cartridge was driven in the image forming apparatus main assembly 100 is computed using an equation as it was in the fourth embodiment, and the obtained value referred to as "drum usage amount" as it was in the fourth embodiment.

(2) The process cartridge is provided with a memory, in which threshold values pertaining to the drum usage data, determined by the characteristics of the photosensitive drum 1 and charge roller 2, the coefficients pertaining to the equation, and the drum sensitivity, are stored in the memory.

(3) The initial levels of DC bias for charge and DC bias for development, are determined for each cartridge according to its drum sensitivity. Thereafter, the amount of the cartridge usage is computed based on the length of time the charge bias is applied, the length of time the photosensitive drum 1 is driven, which are measured by the image forming apparatus main assembly, and the coefficient, and as the value of the thus obtained amount of the cartridge usage reaches the threshold value stored in the memory, the DC bias for charge and the DC bias for development are switched. With this control, it is possible to minimize the line width change that occurs in the initial period of a printing operation, and therefore, high quality is realized.

Next, referring to FIGS. 30 and 31, the structure for controlling the memory in this embodiment will be described.

Figure 30:
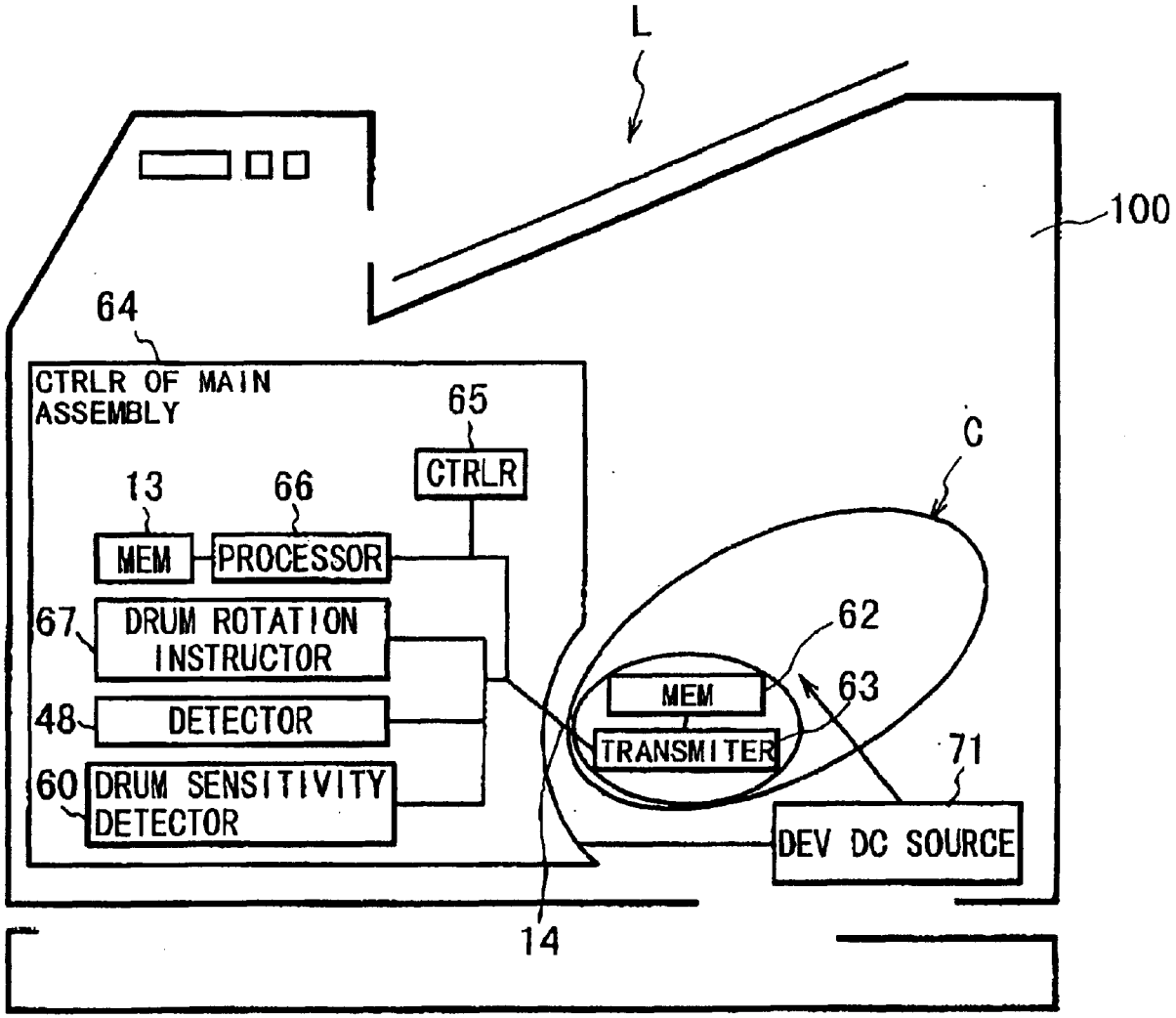
FIG. 30 is a block diagram which shows the relationship between the control portion on the main assembly side and the information in the memory, in the fifth embodiment of the present invention.

As shown in FIG. 30, the control section 64 on the main assembly side has data storage memory 13, a control portion 65, a computing portion 66, a photosensitive member rotation control portion 67, a charge bias application time detecting portion 68, a communication portion 14, whereas the cartridge C side has a memory 62 and a communicating portion 63.

Figure 31:
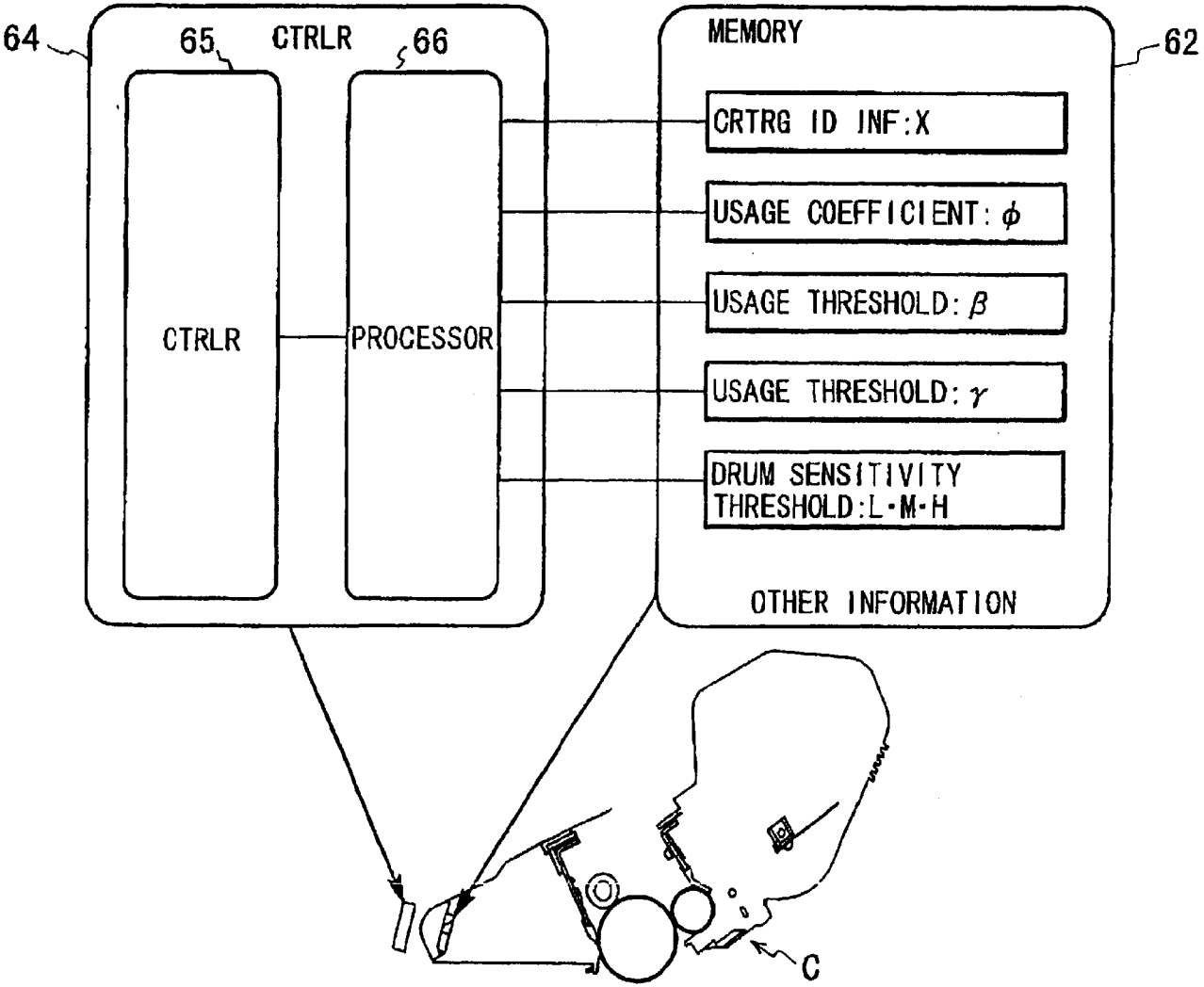
FIG. 31 is a block diagram which shows the relationship between the control portion on the main assembly side and the information in the memory.

FIG. 31 shows the information stored in the memory 62. Although there are various types of information stored in the memory 62, at least the following sorts of information are stored in this embodiment: coefficient φ pertaining to the equation for computing the length of drum usage, threshold values β and γ pertaining to the equation for computing the drum usage; and drum sensitivity threshold values L.M.H, and also a cartridge identification information X as in the fourth embodiment. The threshold values β and γ, coefficient φ, and drum sensitivity are stored in the memory 62 at the time of shipment. These values are selected to be optimal for the characteristics of the photosensitive drum, and other components used in a given cartridge.

These types of information in the memory 62 are rendered always transmittable between the communicating means 63 and 14. The computation is carried out based on these types of information, and the results of the computation are compared to the stored data by the control portion 65.

Next, the control operation in this embodiment will be described.

As the cartridge C is inserted into the image forming apparatus main assembly 100, the control portion 65 accesses the memory 62, and reads the drum sensitivity value.

In this embodiment, the drum sensitivity is divided into three ranges: H≧−120 V; M==120 to −170 V; and L<170.

Based on this information, the control portion 65 sets the initial level of the bias applied by the development DC bias power source 71. In this embodiment, it is set at −510 V, −490 V and −470 V, when the drum sensitivity is in the ranges of L, M and H, correspondingly.

As the apparatus main assembly 100 receives a print signal, the driving of the cartridge C is started by the photosensitive member rotation control portion 64 to start an image forming process. At this point in time, the drum usage amount is computed as follows, as in the first embodiment.

The drum usage amount D is computed by the computing portion 66 using a weighted conversion equation: $D=A+(B\times\phi)$, wherein B stands for the cumulative data of the photosensitive member rotation time, which is obtained from the photosensitive member rotation control portion 67; A stands for the cumulative length of time the charge bias was applied, which is obtained from the charge bias application time detecting portion 68, and $\phi$ stands for a weighting coefficient read out of the memory 22. The results are cumulatively stored in the memory 13 within the apparatus main assembly 100.

The value of the cumulatively stored drum usage amount is compared with the threshold values $\beta$ and $\gamma$ in the memory 62 of the cartridge C. In this embodiment, the threshold value $\beta$ is rendered smaller than the threshold value $\gamma$ ($\beta<\gamma$).

If the value of the drum usage amount D is greater than the value of $\beta$, the value of the development DC bias applied from the development DC bias power source 71 is lowered to 20 V through the control portion 65. More specifically, when the drum sensitivity is in the range L, M and H, the development bias is switched to −490 V, −470 V and −450 V, correspondingly.

As the cartridge C in used more, the amount D of the usage of the photosensitive drum 1 increases. Then, as the drum usage amount D becomes greater than threshold value $\gamma$, the value of the development bias applied from the development DC bias power source 71 is lowered by 20 V through the control portion 65. More specifically, when the drum sensitivity is in the range L, M and H, the development bias is switched to −470 V, −450 V and −430 V, correspondingly.

The data regarding the length of the photosensitive member rotation time, and the data regarding the length of the charge bias application time, are continuously stored in the memory, and the drum usage data are computed whenever the driving of the photosensitive drum 1 is stopped.

Figure 32:
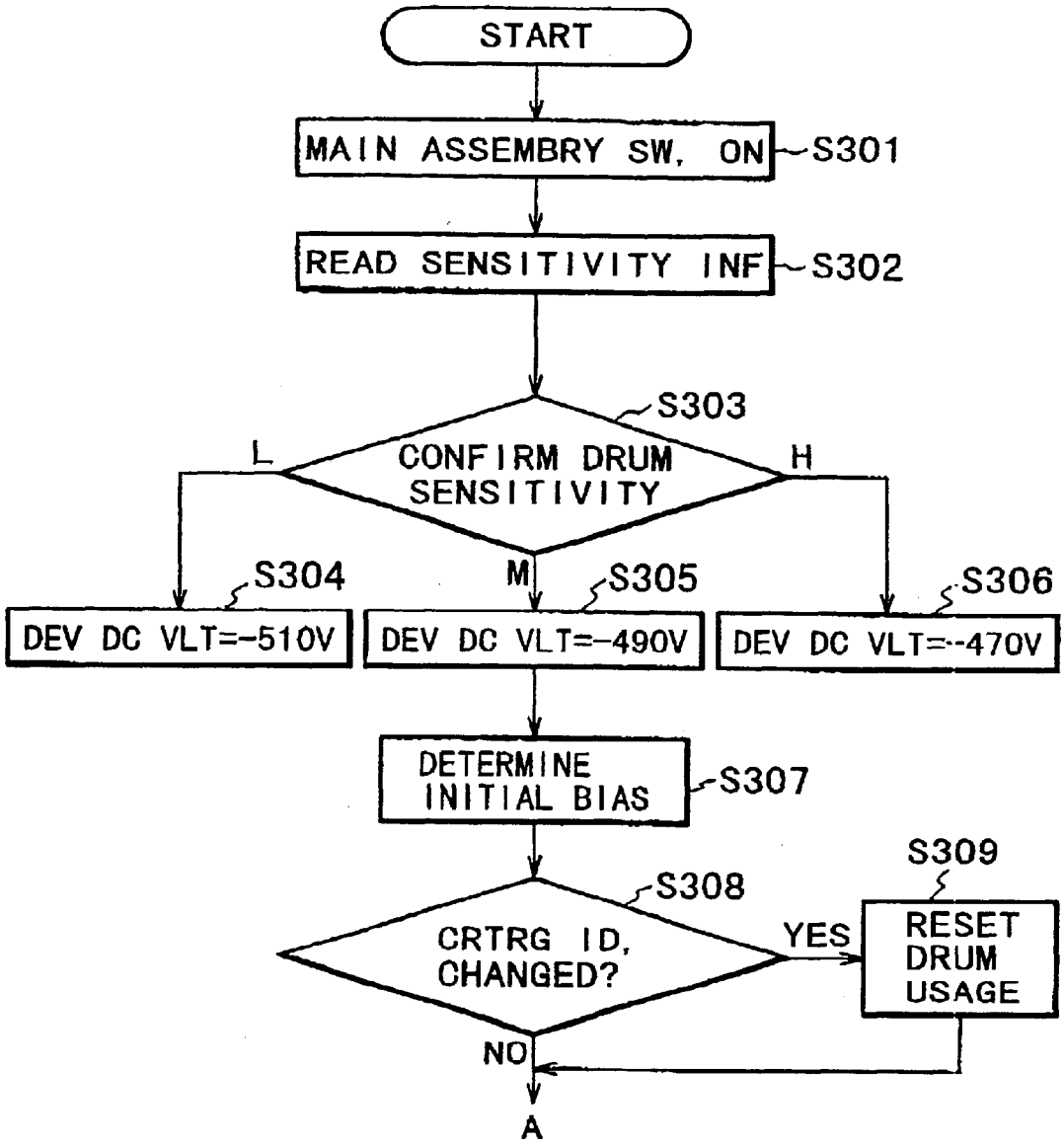
FIG. 32 is a flow chart for the image forming operation in the fifth embodiment of the present invention, in which drum sensitivity is also taken into consideration.
Figure 33A:
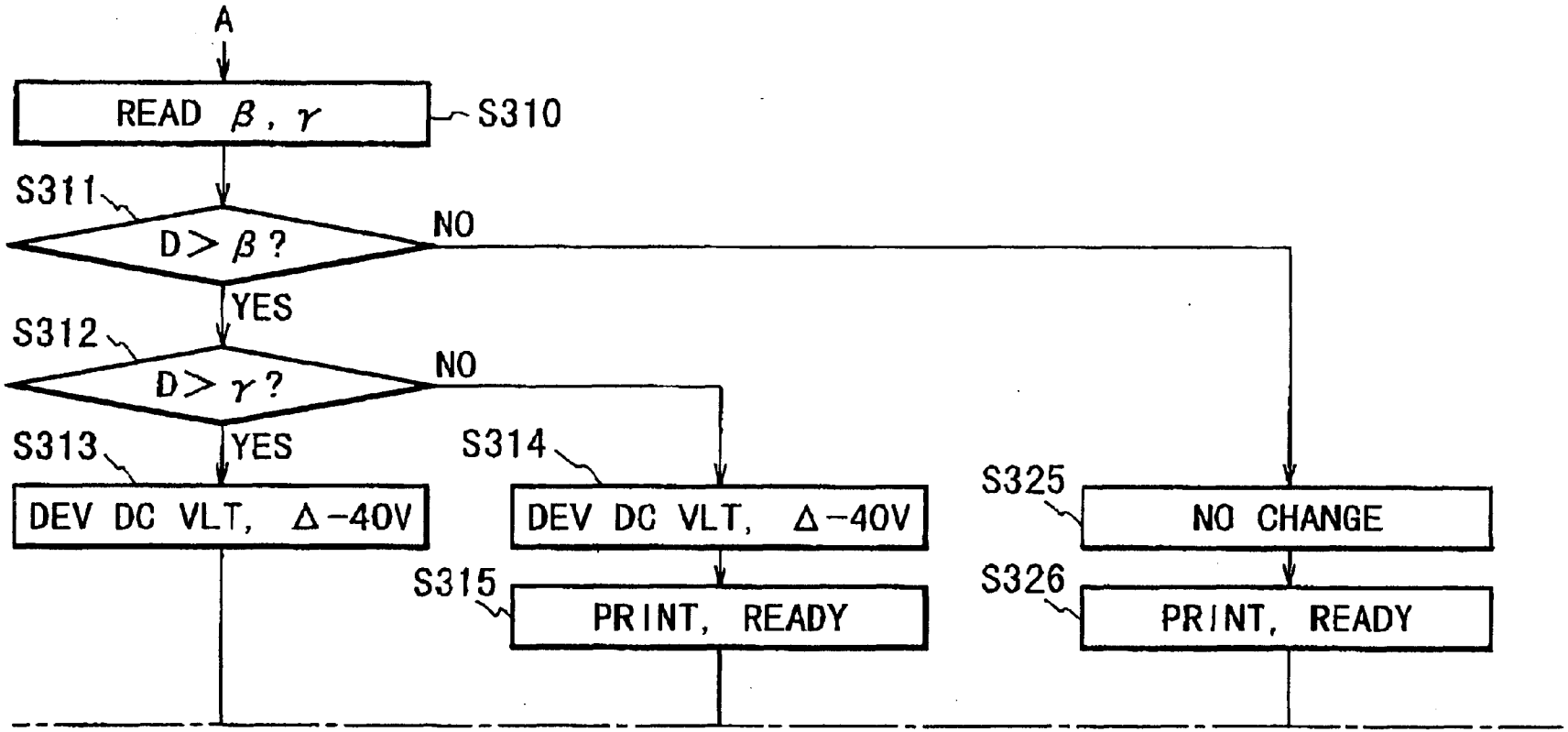
FIG. 33 is a flow chart for the image forming operation in the fifth embodiment of the present invention, in which drum sensitivity is also taken into consideration.
Figures 33, 33B:
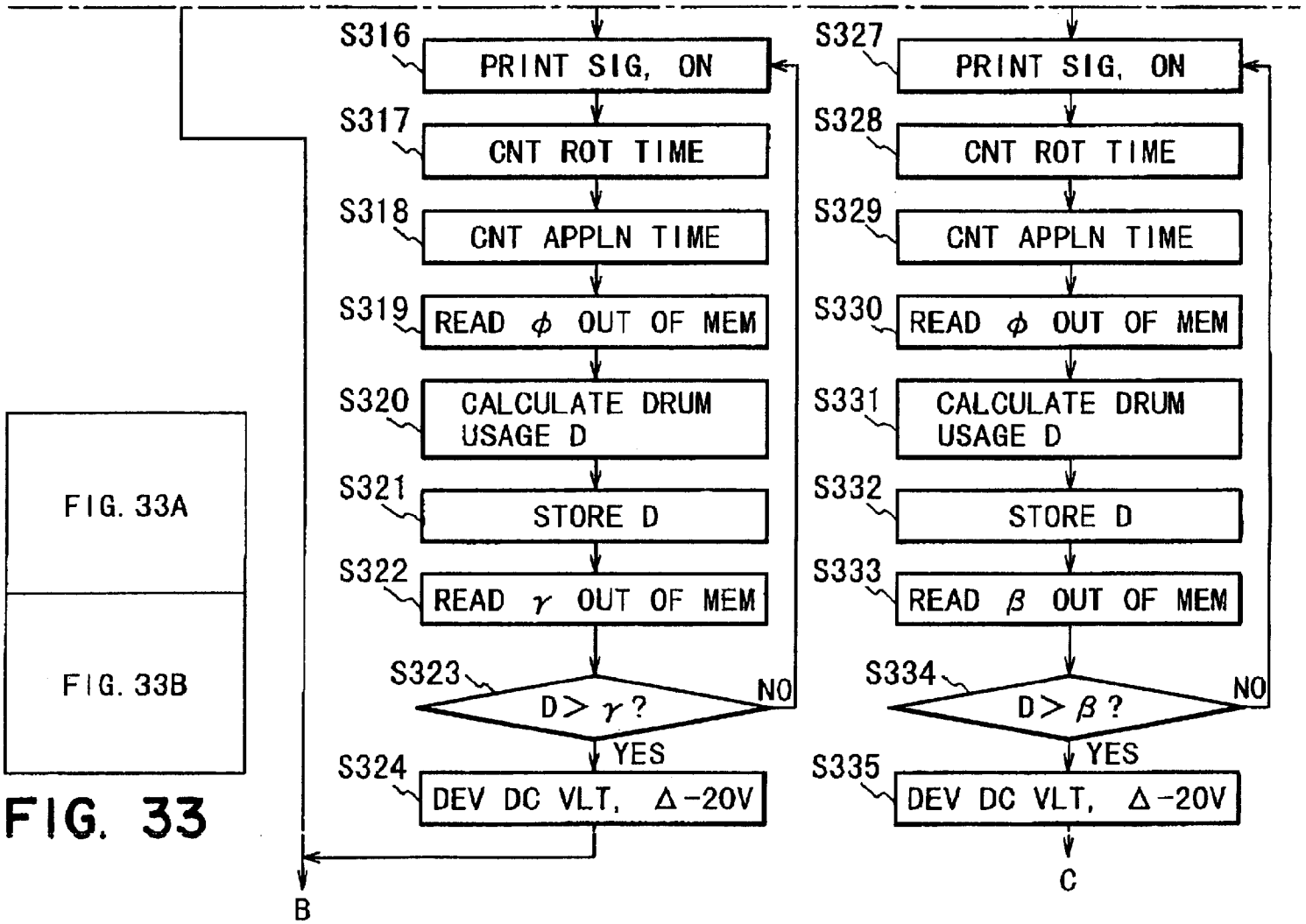
Figure 34:
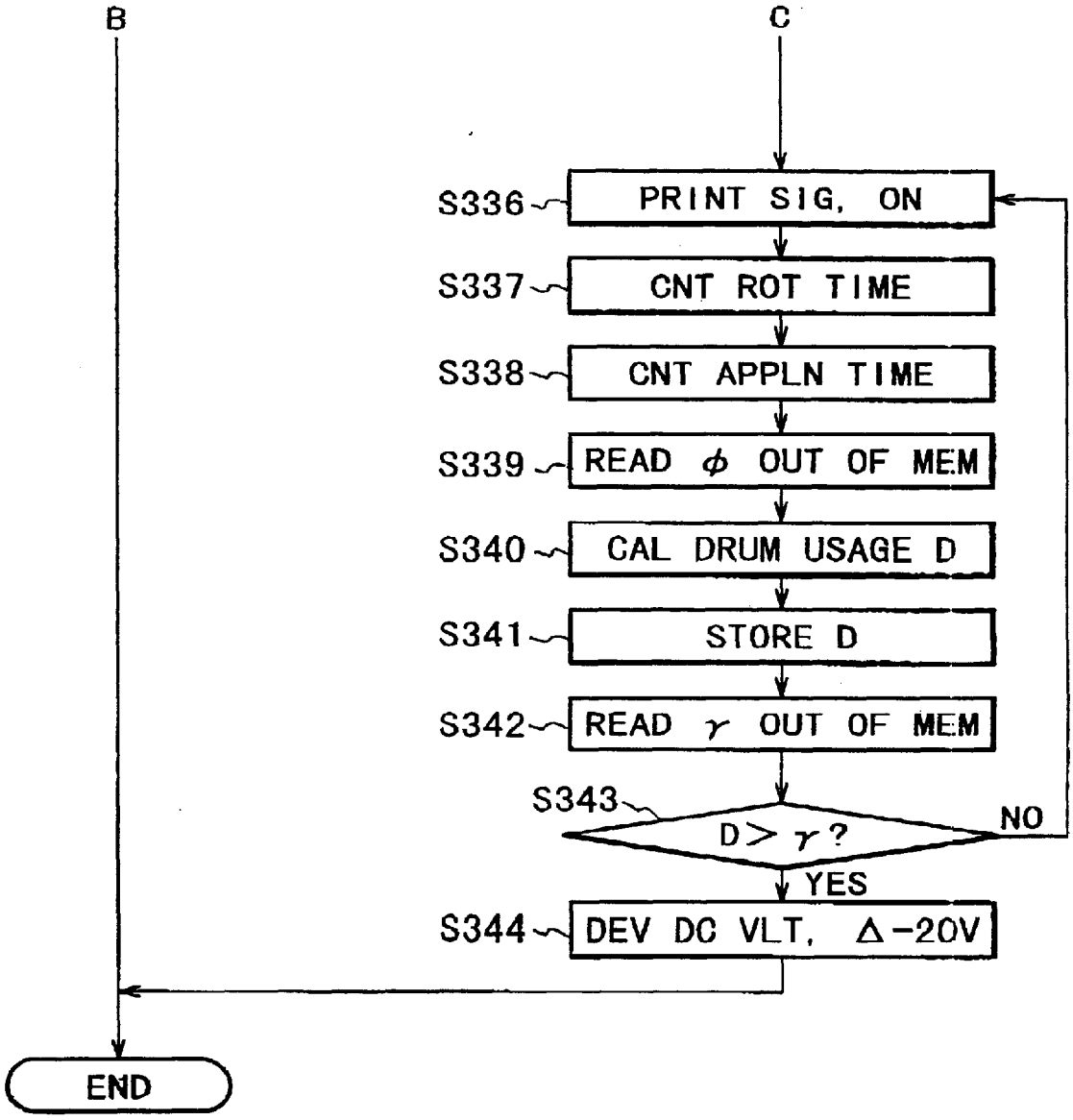
FIG. 34 is a flow chart for the image forming operation in the fifth embodiment of the present invention, in which drum sensitivity is also taken into consideration.

Next, referring to the flow charts in FIGS. 32, 33 and 34, the operation of the image forming apparatus in this embodiment will be described.

The operation of the image forming apparatus is started (START), and each of the following steps S301–S344 is carried out:

S301: the power source of the image forming apparatus main assembly is turned on;

S302: the control portion 65 confirms the drum sensitivity information in the memory 62; if the sensitivity is in the range L, M and H, the operation goes to S304, S305 and S306, correspondingly;

S304: since the sensitivity is in the range L, the initial value of the development bias is set to −510 V;

S305: since the sensitivity is in the range M, the initial value of the development bias is set to −490 V;

S306: since the sensitivity is in the range H, the initial value of the development bias is set to −470 V;

S307: the initial value of the development bias is set;

S308: the cartridge ID information is checked to confirm whether or not the cartridge has been replaced;

S309: if the ID has been changed, the drum usage amount data is reset to zero;

S310: the threshold values $\beta$ and $\gamma$ are read from the memory 62;

S311: the drum usage amount data D is compared with the threshold value $\beta$; if $D>\beta$, the operation advances to S312, whereas if not, the operation advances to S325;

S312: the drum usage amount data D is compared with the threshold value $\gamma$; if $D>\gamma$, the operation advances to S313, whereas if not, the operation advances to S314:

S313: when the power source is on, and the drum usage amount data D satisfies: $D>\gamma$, the development bias is lowered by −40 V, and the control operation is ended;

S314: when the power source is on, and the drum usage amount data D satisfies: $\gamma>D>\beta$, the development bias is lowered by −20 V, and the operation advances of S315;

S315; the apparatus is readied for printing;

S316: a printing signal is turned on;

S317: the photosensitive member rotation time detecting section begins to count the length of the photosensitive member rotation time;

S318: the charge bias application time detecting portion begins to count the length of the charge bias application time;

S319: the coefficient $\phi$ is read from the memory 62 of the process cartridge C;

S320: the drum usage amount D is computed by the computing portion 66;

S321: the drum usage amount D is stored in the memory 13 of the apparatus main assembly 100;

S322: the threshold value $\gamma$ is read by the control portion 65;

S323: the control portion 65 compares the drum usage amount data D with the threshold value $\gamma$; if the answer is "YES", the operation advances of S324, whereas if the answers is "NO", the operation returns to S316;

S324: the development bias is lowered by −20 V, and the control is ended;

S325: when the power source is on, and the drum usage amount D satisfies: $D>\gamma$, the operation advances to S325 without changing the development bias;

S326–S332: (this sequence is identical to the sequence S316–S321, and therefore, its description will be omitted);

S333: the threshold value $\beta$ is read by the control portion 65;

S323: the control portion 65 compares the drum usage amount data D with the threshold value $\beta$; if the answer is "YES", the operation advances to S335, whereas if the answer is "NO", the operation returns to S327;

S335: the development bias is lowered by −20 V, and the operation advances to S336;

S336–S341: (this sequence is identical to the sequence S316–S321, and therefore, its description will be omitted);

S342: the threshold value $\gamma$ is read by the control portion 65;

S343: the control portion 65 compares the drum usage amount data D with the threshold value $\gamma$; if the answer is "YES", the operation advances to S344, whereas if the answer is "NO", the operation returns to S336;

S344: the development bias is lowered by −20 V, and the control is ended.

This concludes the control operation (END).

Referring to FIG. 12, the change in the line width which occurred as the result of control such as the one described above is represented by the single dot chain line. As is evident from FIG. 12, the changes in line width remained within an acceptable range of 180–190 μm, assuming image stability.

As described above, the charge and development DC biases applied in the initial period of an image forming operation are adjusted for each cartridge, according to the drum sensitivity information and drum usage data, prior to the step of "image formation standby ON". Thereafter, the biases are varied to proper levels in accordance with the characteristic value of each cartridge, during the operation, so that the line width remains stable.

Although two threshold values were provided pertaining to the drum usage data, in this embodiment three or more threshold values may be provided in consideration of the characteristics of the initial condition and structure of a cartridge. Further, in this embodiment, the biases were lowered by a single unit of change during each control subsequence. However, it may be lowered by a plurality of units per control subsequence.

Further, in this embodiment, development voltage is varied in potential level to control the image forming process. However, the charge DC voltage may be varied as the same time as the development voltage in order to maintain the contrast between the potential levels of the charge voltage and development voltage. Further, the other factors, that is, the frequencies of the charge and development voltages, and the amount of exposure, may be altered to control the image forming process, which is obvious.

While the invention has been described with reference to the structures disclosed herein, it is not confined to the details set forth and this application is intended to cover such modifications or changes as may come within the purposes of the improvements or the scope of the following claims.

What is claimed is:

1. A control system for controlling an image forming apparatus including a main assembly and a process cartridge, the process cartridge including a photosensitive drum, charging means and developing means, said system comprising:

a memory device provided on the process cartridge and including a first memory portion for storing an integrated time X of rotation of the photosensitive drum; a second memory portion for storing a weighting factor Φ; a third memory portion for storing an integrated time Y of charging bias voltage applied to the charging means; a fourth memory portion for storing a threshold level for switching a developing bias voltage applied to the developing means;

calculating means, provided in the main assembly of the apparatus, for calculating an amount of use of the drum by XΦ+Y; and switching means, provided in the main assembly of the apparatus, for switching the developing bias voltage in response to a result of the calculation of said calculating means reaching the threshold.

2. A control system for controlling an image forming apparatus including a main assembly and a process cartridge, the process cartridge including a photosensitive drum, charging means and developing means, said system comprising:

a memory device provided on the process cartridge and including a first memory portion for storing an integrated time X of rotation of the photosensitive drum; a second memory portion for storing a weighting factor Φ; a third memory portion for storing an integrated time Y of charging bias voltage applied to the charging means; a fourth memory portion for storing a threshold level for switching a charging current imparted to the charging means;

calculating means, provided in the main assembly of the apparatus, for calculating an amount of use of the drum by XΦ+Y; and switching means, provided in the main assembly of the apparatus, for switching a charging current in response to a result of the calculation of said calculating means reaching the threshold.

3. A control system for controlling an image forming apparatus including a main assembly and a process cartridge, the process cartridge including a photosensitive drum, charging means and developing means, said system comprising:

a memory device provided on the process cartridge and including a first memory portion for storing an integrated time X of rotation of the photosensitive drum; a second memory portion for storing a weighting factor Φ; a third memory portion for storing an integrated time Y of charging bias voltage applied to the charging means; fourth and fifth memory portions for storing threshold levels for switching a developing bias voltage applied to the developing means and switching a charging current imparted to the charging means, respectively;

calculating means, provided in the main assembly of the apparatus, for calculating an amount of use of the drum by XΦ+Y; and switching means, provided in the main assembly of the apparatus, for switching the developing bias voltage and for switching the charging current in response to the results of the calculations of said calculating means reaching the thresholds.

4. A control system according to claim 1, wherein said memory device further includes a second threshold level for switching the developing bias voltage applied to the developing means, and said switching means further switches the developing bias voltage in response to a result of the calculation of said calculating means reaching the second threshold.

5. A control system according to any one of claims 1–4, wherein the charging means contacts the photosensitive drum.

6. A control system according to claim 5, wherein the charging means is supplied with an AC voltage biased with a DC voltage.

7. A control system according to any one of claims 1–4, wherein said memory device communicates with the main assembly without physical contact with the main assembly.

8. A control system according to claim 8, wherein said memory device communicates with the main assembly by electromagnetic wave transmission.

9. A control system according to any one of claims 1–4, wherein the developing means is supplied with a voltage which is a rectangular AC voltage biased with a DC voltage.

10. A control system according to claim 3, wherein the threshold levels are common for switching the developing bias voltage and for switching the charging current.

11. A control system for controlling an image forming apparatus including a main assembly and a process cartridge, the process cartridge including a photosensitive drum, charging means and developing means, said system comprising:

a memory device provided on the process cartridge and including a first memory portion for storing an integrated time X of rotation of the photosensitive drum; a second memory portion for storing a weighting factor Φ; a third memory portion for storing an integrated time Y of charging bias voltage applied to the charging means; fourth and fifth memory portions for storing threshold levels for switching a developing bias voltage applied to the developing means and switching a charging current imparted to the charging means, respectively;

calculating means, provided in the main assembly of the apparatus, for calculating an amount of use of the drum by XΦ+Y; and switching means, provided in the main assembly of the apparatus, for switching the developing bias voltage and for switching the charging current in response to the results of the calculations of said calculating means reaching the thresholds, wherein the charging means contacts the photosensitive drum and is supplied with an AC voltage biased with a DC voltage, wherein said memory device communicates with the main assembly by electromagnetic wave transmission without physical contact therewith, wherein the developing device is supplied with a voltage which is a rectangular AC voltage biased with a DC voltage.

* * * * *

UNITED STATES PATENT AND TRADEMARK OFFICE

CERTIFICATE OF CORRECTION

PATENT NO. : 6,608,975 B2
DATED : August 19, 2003
INVENTOR(S) : Kazushige Sakurai et al.

It is certified that error appears in the above-identified patent and that said Letters Patent is hereby corrected as shown below:

Title page,
Item [56], References Cited, U.S. PATENT DOCUMENTS, insert:

| | | |
|---|---|---|
| -- 2002/0018658 | 2/14/02 | Sakai, et al. |
| 2002/0041767 | 4/11/02 | Saito, et al. -- |

FOREIGN PATENT DOCUMENTS, insert:

| | | |
|---|---|---|
| -- JP 10-39693 | 2/13/98 | Japan |
| JP 9-190143 | 7/22/97 | Japan |
| JP 10-133545 | 5/22/98 | Japan |
| JP 9-179460 | 7/11/97 | Japan |
| JP 10-39691 | 2/13/98 | Japan |
| JP 10-186972 | 7/14/98 | Japan |
| JP 2002-6569 | 1/9/02 | Japan |
| JP 2002-49225 | 2/15/02 | Japan |
| JP 10-39723 | 2/13/02 | Japan |
| JP 10-39716 | 2/13/02 | Japan -- |

Figure 20:
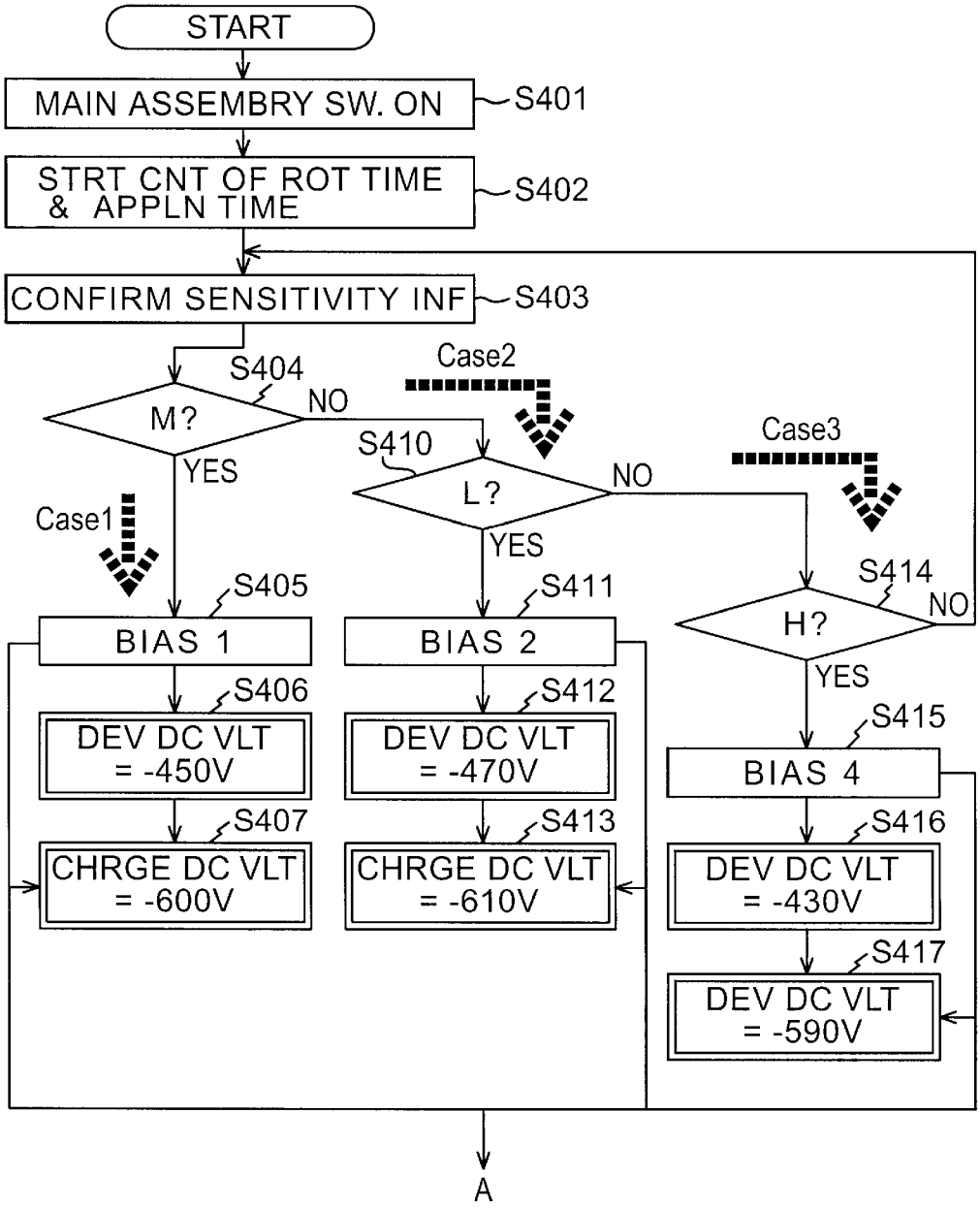
FIG. 20 is a flow chart for the image forming operation in the third embodiment of the present invention.

Drawings,
Sheet 19, FIG. 20, “ASSEMBRY” should read -- ASSEMBLY --.
Sheet 31, FIG. 32, “ASSEMBRY” should read -- ASSEMBLY --.

Column 6,
Line 51, “ion” should read -- on --.

Column 8,
Line 20, “In” should read -- in --.

Column 10,
Line 61, “a” should read -- α --.

Column 11,
Line 51, “S203;” should read -- S203: --.

Column 15,
Line 41, “S303;” should read -- S303: --.

Column 16,
Line 42, “sands” should read -- sends --.

UNITED STATES PATENT AND TRADEMARK OFFICE

CERTIFICATE OF CORRECTION

PATENT NO. : 6,608,975 B2
DATED : August 19, 2003
INVENTOR(S) : Kazushige Sakurai et al.

It is certified that error appears in the above-identified patent and that said Letters Patent is hereby corrected as shown below:

Column 19,
Line 9, “S405;” should read -- S405: --.
Line 15, “S406;” should read -- S406: --.

Column 20,
Line 4, “S425;” should read -- S425: --.

Column 21,
Line 27, “S436;” should read -- S436: --.

Column 22,
Line 59, “Image” should read -- image --.

Column 23,
Line 35, “replaced:” should read -- replaced; --.

Column 25,
Line 16, “S216;” should read -- S216: --.
Line 33, “value” should read -- values --.

Column 28,
Line 14, “S314:” should read -- S314; --.

Column 30,
Line 57, “claim 8,” should read -- claim 7, --.

Signed and Sealed this

Thirtieth Day of March, 2004

JON W. DUDAS
*Acting Director of the United States Patent and Trademark Office*